US006415575B1

(12) United States Patent
Thompson

(10) Patent No.: US 6,415,575 B1
(45) Date of Patent: Jul. 9, 2002

(54) ZIPPER SHEATHING TIE DOWN

(76) Inventor: Thomas Thompson, 92-543 Kokole Pl., Makakilo, HI (US) 96707

( * ) Notice: Subject to any disclaimer, the term of this patent is extended or adjusted under 35 U.S.C. 154(b) by 0 days.

(21) Appl. No.: 09/389,677

(22) Filed: Sep. 2, 1999

(51) Int. Cl.[7] ..... E04B 1/38
(52) U.S. Cl. ..... 52/712; 52/714; 52/715
(58) Field of Search ..... 52/712, 714, 715

(56) References Cited

U.S. PATENT DOCUMENTS

| | | | | | |
|---|---|---|---|---|---|
| 813,253 | A | * | 2/1906 | Sullivan | 52/715 |
| 1,547,184 | A | * | 7/1925 | Venzie | 52/715 |
| 1,931,739 | A | * | 4/1932 | Rutten | 52/715 |
| 1,867,194 | A | * | 7/1932 | Taylor | 52/715 |
| 3,210,898 | A | * | 10/1965 | Kurtz | 52/715 |
| 3,398,982 | A | * | 8/1968 | Venzie, Jr. | 52/715 |
| 3,553,919 | A | * | 1/1971 | Omholt | 52/715 |
| 5,390,460 | A | | 2/1995 | Liorews | |
| 5,423,156 | A | | 6/1995 | Neillessen | |
| 5,653,079 | A | * | 8/1997 | Loeffler | 52/715 |

* cited by examiner

*Primary Examiner*—Carl D. Friedman
*Assistant Examiner*—Kevin McDermott

(57) ABSTRACT

An improved metal connector that securely ties together sheathing and underlying structural members on a building to prevent hurricane and earthquake damage. The connector has alternating sheathing tabs for securing adjacent sheathing edges. Connected underneath the sheathing tabs, a rib separates the sheathing and correctly spaces each adjoining sheet with a slight gap to avoid buckling. Below the rib, rafter webs alternate with the sheathing tabs to prevent movement of the sheathing and rafter. The large surface area and precise nail holes on the sheathing tab avoids sheathing splitting and assures correct attachment to the underlying structural member.

8 Claims, 20 Drawing Sheets

ZIPPER SHEATHING TIE DOWN

BACKGROUND-FIELD OF INVENTION

This invention relates to an invention sent in on Jan. 07, 1999 and is an innovative connector that positively holds down sheathing to create buildings that are resistant to earthquakes, hurricanes, tornadoes, and strong winds.

BACKGROUND-DESCRIPTION OF PRIOR ART

BACKGROUND

Recent studies of hurricane damage on wood-frame buildings indicate that the most extensive destruction to a house by strong winds, was when the roof sheathing was torn off and rain ruined everything in the house.

Roof sheathing ties all the rafters together on a wood frame house, and the roof sheathing tries all the roof trusses together when a masonry or wood-frame house is constructed with trusses. The roof sheathing helps prevent the trusses from racking, or tilting perpendicular to their length.

Sheathing that is tightly secured to the roof and subsequently fastened to the walls, helps transfer uplifting forces to the walls and henceforth to the foundation. If the roof sheathing fails, the trusses collapse, and the walls usually fall down as they can not stand by themselves against strong winds.

Failure and loss of the roof sheathing is common during hurricanes, mainly because of inadequate fastening of the roof sheathing to the underlying structural members. The roof system provides stability to a house by bracing the tops of exterior and interior load-bearing walls.

Sheet metal joints perform better than nailed joints in high winds and during seismic activity. Strong connectors, secured by well placed fasteners, will insure that the major structural members of a house are securely tied together.

HURRICANES

Studies of damage after Hurricane Andrew show several problems with the attachment of roof sheathing that this invention solves. Some sheets of roof sheathing that were blown off houses contained no nail holes, indicating that the sheet was placed in position, but was not nailed down. Some roofing sheets had nails in them that had missed the rafter that they should have been nailed upon. Some sheets had staples or nails that had rusted away, and on some sheets the nails had just pulled out from the rafter.

The engineering staff of the American Plywood Association provided technical personnel to assess the damage from Hurricane Andrew in Florida. The majority of wood structural sheathing failures were attributed to improper connection details, and in every case investigated, the sheathing loss was a result of improper nailing (Keith, 1992).

These problems have not been solved because staples are still used to tie down roof sheathing, and by looking at new construction, nails are still seen poking through the roof sheathing, completely missing the roof rafter. Most conscientious framers would drive another nail when they felt the nail miss the underlying rafter, but with the new powered nail guns, the framer can not tell if the rafter was missed because each shot feels the same, no matter what the nail is being driven into.

EARTHQUAKES

During an earthquake, the floor, wall, and roof diaphragms undergo shearing and bending. The shear forces from the roof boundary members are transferred to the top of the shear wall by way of toenails or blocking to the top plate. To withstand and transfer the shear loads, plywood sheets have to be spliced together to prevent adjoining edges from sliding past or over each other (Gray, 1990).

Butted together on the centerline of a 2×4, 2×6, etc. (nominally 1½-inches-wide), you've only got ¾ inch bearing for each plywood sheet, so the nail has to be ⅜ inch from the edge. This leaves little margin for error, and nailing has to be done with care to avoid splitting the plywood and missing or splitting the underlying member (Gray, 1990).

Tests at the University of California show that plywood secured by overdriven nails, nails that penetrated the plywood beyond the first veneer (usually by a powered nailgun), failed suddenly and at loads far below those carried by correctly nailed plywood panels (Gray, 1990).

Steel connectors, between different components of a wood-frame building's superstructure, provide continuity so that the building will move as a unit in response to seismic activity (Yanev, 1974).

PRIOR ART

A number of connectors have been developed to tie together the structural members of a house under construction. Up until this invention, nobody had seen how to make a compact connector that could tie two or more sheathing sheets together and to the underlying structural members, or could be applied from the top of the roof.

Some prior art prevents uplift, but this invention not only prevents uplift during hurricane-force winds, but prevents lateral movement during earthquakes.

I invented a previous sheathing tie that wrapped around a structural member and attached to the sheathing by a different method. That invention was sent in for patent protection on Jan. 7, 1999 as application Ser. No. 09/227,059.

The Simpson Strong-Tie Co.'s January 1996 catalog (page 62) lists a PSCL Plywood Sheathing Clip. This clip provides a gap and aligns sheathing but does not tie the sheathing to underlying structural members or prevent uplift or lateral movement. No other sheathing ties were found in their catalog, but they do show several seismic and hurricane ties on pages 60–61.

A prior art roof securing system by Llorens, U.S. Pat. No. 5,390,460 ties down a single sheet of roof sheathing to a support beam. This is a good connector, but it is long, and can only tie down one-size of sheathing. It must be hammered around the beam from below, but panels are installed from above the roof. Llorens' 460 can only tie down one panel and provides little lateral support.

Another sheathing strap and alignment guide by Nellessen, U.S. Pat. No. 5,423,156 shows an apparatus for securing sheathing using a long strap, connecting bands, and saddles. This is a good connector, but it is long, complicated, and must be installed from below the roof. With sheathing in place, this is difficult. Nellessen's 156 can only tie down panels of one size.

According to the magazine Fine Homebuilding, October/November, 1998, sheathing courses should begin with either a full or half sheet. The course of sheathing at the top row and beginning row are often odd-size, in order to get a reasonable width of sheathing on the top row.

OBJECTS AND ADVANTAGES

Accordingly, several objects and advantages of my invention are that it helps secure the roof, wall, and floor of a building to keep the building from being destroyed by hurricanes, tornadoes, and earthquakes.

This invention helps prevent the wall of a building from detaching from the wall studs during a hurricane or earthquake. It makes the wall into a stable shearwall, transferring shear forces into the foundation and ground.

This invention helps prevent the roof of a building from detaching from the rafters or roof trusses during a hurricane. It ties the roof sheathing securely to the underlying rafter or roof trusses, transferring lateral and uplift forces to the walls and to the foundation.

This invention helps prevent the floor of a building from detaching from the floor joists during an earthquake. It makes the floor into a horizontal shear wall, and helps the floor resist lateral forces in its horizontal plane. It also makes sure that any forces transferred from the roof and wall can be managed by the floor and transferred properly to the ground.

One object of this invention is to make each sheathing structure on a house into a shearwall, that is, able to transfer forces without breaking or disconnecting. By tying the plywood securely to the underlying structural member, the plywood can reliably transfer and dissipate shear, lateral, and uplift forces to the ground.

During an earthquake or a hurricane, another object is for the building with my invention to move as a sturdy unit, resisting and transferring destructive forces to the ground. Mounted on the roof sheathing and rafter, my invention resists uplift, the most destructive force during a hurricane. Mounted on the wall stud and wall sheathing, my invention prevents the wall sheathing from being blown off or sucked out by the extreme negative pressure of a hurricane. Mounted on the floor sheathing and floor joists, my invention prevents the floor from separating, if it should get wet during a hurricane.

During an earthquake, when my invention is mounted on the roof, walls, and floors, they will turn each member into a shear wall. The secured plywood will absorb and dissipate earth movements, without becoming detached from the underlying structural members. It will also prevent the sheathing from sliding over or past each other.

This could improve a house to existing building codes, as sheet metal joints have been proven to perform better than nailed joints during hurricanes and earthquakes.

Another object of this invention is the large surface area on the top or outside part of the sheathing. This area prevents the plywood sheathing from splitting during nailing. The large surface area provides more strength in the hold-down process.

Still another advantage is the accurately placed nail holes on the invention. These nail holes prevent nails from splitting the plywood or underlying rafter, stud, or joist, by making the framer place nails at the correct and accurate location.

Another advantage is that the invention prevents overdriven nails from penetrating the fragile outer veneer of the plywood sheathing. The accurately placed nail holes prevent the nailhead from piercing the outer veneer of the plywood.

Another advantage is that some nails, on the invention, are driven into the strong broad side of a rafter, stud, or joist, forming a very strong connection to the sheathing, preventing the nails from pulling out.

Yet another advantage of this invention is during earthquakes, nails can sometimes bend with the movements of the house, but screws often break. Even though screws hold tighter than nails and provide a tight connection against uplifting forces from hurricanes, they are less resistant against earth movements. This invention absorbs and transmits most of the forces during an earthquake and hurricane so nails and/or screws can be used as fasteners.

Another advantage is that since the invention absorbs and transfers earthquake and hurricane forces, less nails and nailing could be used. Also, screws could be used in the invention in earthquake areas with less fear that the heads will shear off.

Still another advantage of the invention is in the ability to prevent plywood sheets from sliding past or over each other during an earthquake. Previously, only nails had to shear, but this entire connector must be sheared for the plywood to slide.

Another advantage is that plywood panels should not be butt together tightly or they may buckle when they expand due to heat or humidity. A slight gap should be left between panels. This invention provides a slight gap between each plywood panel that the invention is installed upon.

Still another advantage is that with the roof sheathing firmly attached to the rafters, roofing material will have a better chance of staying on during strong winds and earth movements. In addition, with the sheathing firmly connected, new materials may be attached to the roof, such as solar electric panels, without fear of them being blown off.

In areas with brush or forest fire danger, fire-proof material or heavy material, such as tile, stone or metal, can be applied to the roof with less danger of being blown or shaken off during earth tremors or high winds.

When the invention is applied to the studs and wall sheathing, fire-proof materials such as stucco or brick veneer can be applied to the sheathing with less chance of being shaken off during earth movements.

When the invention is applied to the floor joists and floor sheathing, the interior load-bearing walls can have a horizontal shear wall, inside the house, to help transfer earth movements.

Earth tremors and hurricanes always destroy the weakest parts of a house. By making each envelope of a house, the vertical walls, horizontal floors, and roof envelope into a strong unit, there will be less damage.

Another advantage is that the building contractor or a building inspector can visually inspect the roof sheathing, wall sheathing, and flooring for correct tie down, and can be assured that all the nails have been correctly placed. Previously, a visual inspection could not determine if the sheathing or flooring was properly applied and secured.

Still another advantage is that the invention can hold down standard-size or odd-size sheathing. According to Fine Homebuilding, October/November, 1998, sheathing courses should begin either with a full or half sheet. The course at the top row and beginning row are often odd-size, so that a reasonable width of sheathing is on the top row.

An advantage is that the framer can more accurately determine where the underlying structural member is located because the tie is on top of the sheathing, in line with the member.

Another advantage is the invention is easily used with current framing methods. The invention is installed from the top side of the sheathing so the framer doesn't have to go under the sheathing, which can be dangerous.

Nailguns can be used to attach this invention if the nail protrudes from the gun, prior to being driven. Nailguns can be used to apply nails to the sheathing and underlying rafter in-between the installed inventions, just like conventional construction. Screw guns can be used as well.

Still another advantage of this invention is when it is applied to the floor joist and floor sheathing, it will keep each sheet of sheathing a slight distance from each other helping prevent squeaks. Also, after a house is built, the wood floor joists and plywood shrink at different rates, causing gaps between them. By being tightly secured with my invention, any gaps will be insignificant, averting any squeaks.

Still another object is that the invention is thin so that a covering or underlayment can be easily applied. There is no "ripping" effect where sharp corners or bends can cause stress points on the waterproof overlay. All bends and edges are smooth.

It is a further object of this invention that it easily, quickly, and economically protects houses from the destructive forces of earthquakes and hurricanes. It is a still further object that the connectors and fasteners are strong, attractive, permanent, functional, uncomplicated, simple to manufacture, easy to install, and economical. All of the embodiments can be made from a single sheet metal blank, without any welding.

A further object is that this invention can be used on various size sheathing, rafters, roof trusses, studs, wood or metal I-beams, TJI, and glue-lams, all made from wood or metal. There may be hurricane, earthquake, fire, and other insurance discounts for homeowners who have this invention installed on their houses.

Previously, architects, engineers, and builders did not know how important the attachment of plywood sheathing was to the roof, walls, and floors. It was thought that the weight of the roof would keep the sheathing attached during a storm. Prior to this invention, no thought had been given to the floor as a horizontal shear wall during an earthquake.

These and other objectives of the invention are achieved by simple and economical connectors that allow a builder to quickly and easily secure the weakest parts of a building against earth tremors and high winds.

Advantages of each will be discussed in the description. Further objects and advantages of my invention will become apparent from a consideration of the drawings and ensuing description.

REFERENCE NUMERALS

Figure 1:
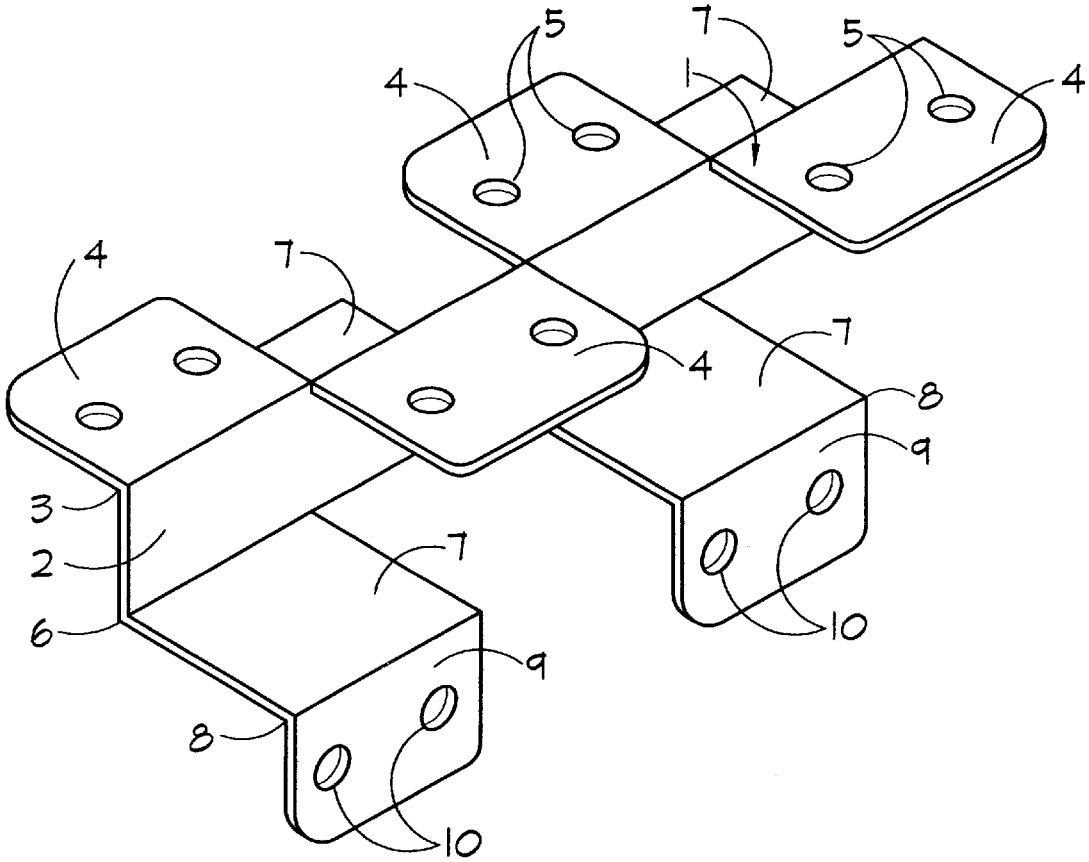
FIG. 1 is a perspective view of a zipper sheathing tie.

1. Zipper sheathing tie
2. Rib
3. Sheathing bend
4. Sheathing tabs
5. Nail holes
6. Rafter bend
7. Rafter web
8. Edge bend
9. Rafter tabs
10. Nail holes
11. Extension
12. Nail holes
13. Reversible
14. Egress
15. Bookend sheathing tie
16. Beam tab
17. Nail holes
18. Gusset
19. Beam bend
20. Back sheathing tab
21. Front sheathing tab
22. Top sheathing bend
23. Nail holes
24. E-clip
25. Right sheathing web
26. Left sheathing tab
27. Nail holes
28. S-clip
29. Left sheathing trap
30. Right sheathing trap
31. Nail holes
32. Adaptable sheathing tie
33. Left sheathing strap
34. Right sheathing strap
35. Left sheathing offset
36. Right sheathing offset
37. Spacer rib
38. Anchor
39. Cable
40. Nail holes
41. Spacer bend
42. ½ zipper
43. Edge zipper
44. Offset bend
45. Edge tab
46. Nail holes
R. Rafter
S. Sheathing
N. Nails
W. Wall stud
P. Sill plate
T. Top plate

DESCRIPTION

FIG. 1

FIG. 1 shows a perspective view of a zipper sheathing tie 1. The zipper 1 consists of a rib 2 that extends the length of the connector. At the top of the rib 2, a right angle bend, called the sheathing bend 3, forms sheathing tabs 4. The sheathing tabs 4 are bent to opposite sides of the rib 2 in an alternating style. The sheathing tabs 4 are perpendicular to the rib 2. The sheathing tabs 4 have accurately spaced nail holes 5 for precise placement of nails into the sheathing and underlying rafter.

At the bottom of the rib 2 a right angle bend, called the rafter bend 6, forms rafter webs 7. The rafter webs 7 are bent to opposite sides of the rib 2 in an alternating style, and are perpendicular to the rib 2.

The rafter webs 7 have right angle bends, on the end opposite the rib 2, called edge bends 8. The edge bends 8 bend downward forming rafter tabs 9. The rafter tabs 9 have nail holes 10 and are parallel to the rib 2.

FIG. 2

Figure 2:
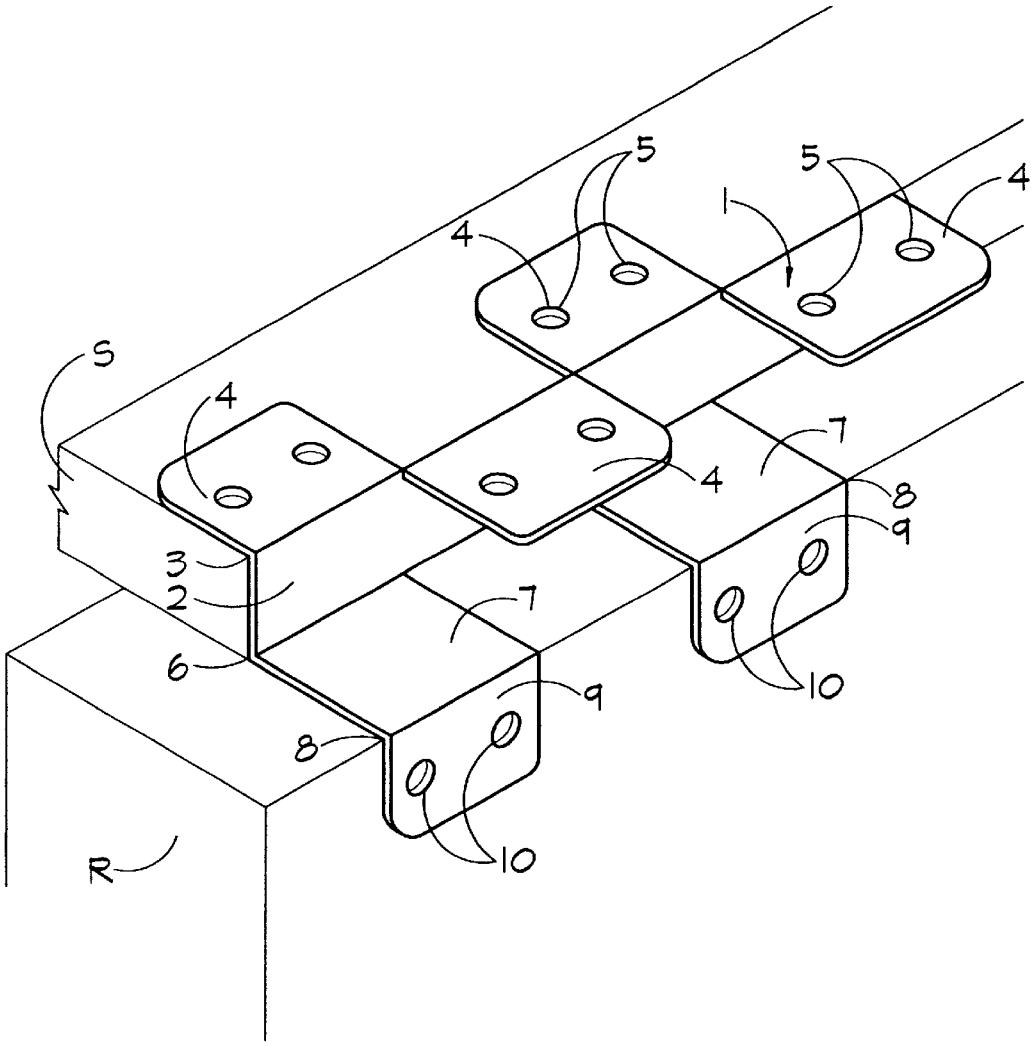
FIG. 2 is a perspective view of a zipper tie holding down roof sheathing.

Refer now to FIG. 2 which shows the zipper 1 tying down a sheet of roof sheathing S on rafter R. This drawing could also be of the top chords in a roof truss, and roof sheathing; sub-flooring on floor joists; or outside sheathing on wall studs, since the invention can work in each location. When describing the rafter, the words "truss chord", "wall stud" and "floor joist" could be substituted, but for ease of writing and reading, this example will be of a rafter.

FIG. 2 shows that plywood sheathing is normally laid down so one edge is on the centerline of a rafter R, parallel to the rafter, and the adjacent edge spanning or crossing the rafters. FIG. 2 shows a zipper 1 securely tying down the edge of a sheet of sheathing S where it is parallel to the length of a rafter R and on the centerline. The zipper 1 can tie another sheet of sheathing S on the right side, but is omitted from this view for clarity.

The rafter tabs 10 wrap around either vertical face of the rafter R and the rafter webs 7 cross over the horizontal face of the rafter R and support the sheathing S. Crossing over the opposite sheathing S and rafter R makes the sheathing to rafter connection very strong. The rafter webs 7 provide resistance to tension, shear, and torsion forces. Hurricane forces try to lift up the sheathing (tension) and twist the sheathing (torsion). Earthquake forces try to slide one sheet of sheathing over another (shear) and twist the sheathing (torsion).

The zipper 1 prevents the above forces from ripping the sheathing from the underlying structural members, by wrapping around three sides of the rafter R and three sides of the sheathing S. The zipper 1 holds down adjacent edges of the sheathing S, preventing the edges of the plywood from sliding past or over each other during earthquakes.

FIG. 2 shows how the zipper 1 prevents uplift forces during strong winds from lifting up the sheathing S because of the clamping effect on the sheathing S by the sheathing tabs 4, rib 2, and rafter webs 7. The large surface area of the sheathing tabs 4 prevents the sheathing S from cracking, splintering, or splitting apart.

The sheathing S is also held down by nails in the nail holes 5 of the sheathing tab 4 going into the sheathing S and rafter R. Nails in the nail holes 10 of the rafter tabs 9 would have to be sheared in order for the sheathing S to lift.

When a zipper 1 is attached to a rafter R, the rib 2 is automatically centered along the centerline of the rafter R. The nail holes 5 in the sheathing tab 4 are approximately ⅜ inch from the rib 2. This assures that nails will attach the maximum amount of sheathing S to the thickest part of the rafter R.

Since the rafter R of a 2×4 is 1½-inches-thick, only ¾ of an inch of sheathing S can lay on either side of the centerline of the 2×4. The zipper 1 automatically spaces out a slight gap between sheets of sheathing S, aligns them perfectly on the centerline of the rafter R, and aligns them for optimum nailing.

FIG. 3

Figure 3:
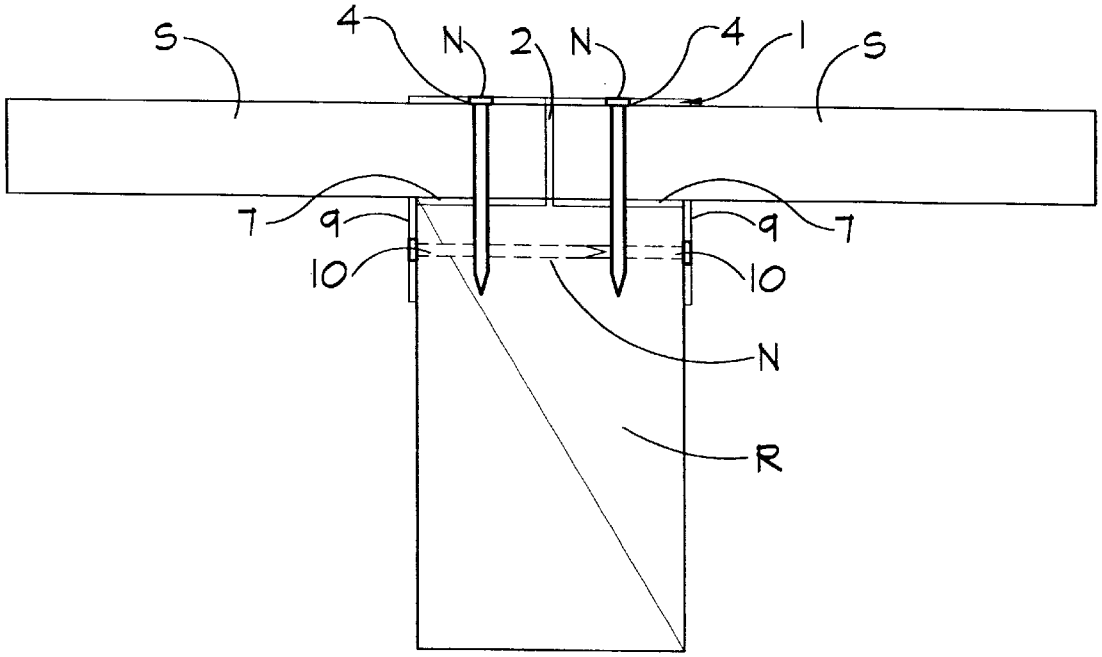
FIG. 3 is a cross section of a zipper.

Refer now to FIG. 3 which shows a cross section through a zipper 1 that has attached two sheathing sheets S to a rafter R. The rafter R is standard 1½ inches-thick, and the sheathing S is standard ⅝ inch-thick. The zipper 1 was installed to a rafter R using nails through nail holes 10 in the rafter tab 9.

The rib 2 is automatically on the centerline of the rafter R which makes installation of the sheathing S quick and easy. The sheathing S will not fly around from the wind, because the sheathing tabs 4 are holding the sheathing S down prior to nailing.

Sheets of sheathing S have been slid up to the zipper 10 from the left and right, and have slipped under the sheathing tabs 4 and above the rafter webs 7. Depending on the length and width of the sheathing S, the zippers 1 can be installed on eight-foot, four-foot, two-foot, or 16-inch centers. The zippers 1 can be installed along the entire edge of the sheathing S or can be spaced apart.

Most 2×4's or 2×6's are only 1½-inches-wide. If two sheets of plywood are to be nailed along this rafter, there can only be ¾ inch of nailing space for each one. Optimally, a nail should be driven ⅜ inch from the edge. This will insure that the nail will not split the plywood, and that the nail will be in the nailing edge or "meat" of the underlying rafter.

If the nail is driven just ⅛ inch closer to the edge of the plywood, the nail may split the plywood. This nail will not properly hold down the plywood, making it prone to moving, sliding, squeaking, or uplift.

If the nail is driven just ⅛ inch further away from the edge of the plywood, the nail may split the edge of the underlying rafter or may miss the rafter entirely.

On the zipper 1, nails driven down from above the sheathing S and through the nail holes 5 of the sheathing tabs 4 have bonded the maximum amount of the edge of the sheathing S. The nails have penetrated the maximum part of the rafter R without splitting the edge of the rafter R. Nails in the vertical and horizontal faces of the rafter R provide maximum holding power between the rafter R and sheathing S.

FIG. 4

Figure 4:
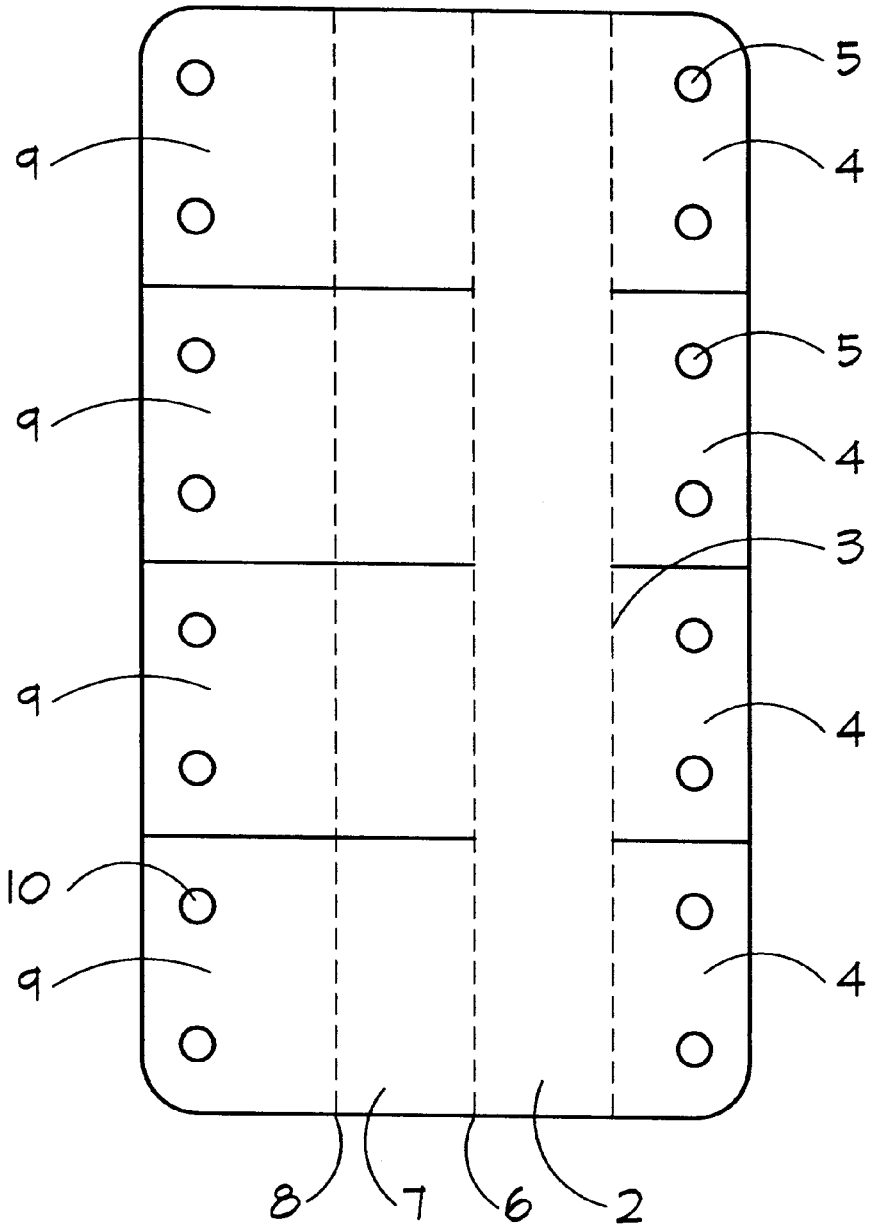
FIG. 4 is a flat pattern layout for a zipper.

Refer now to FIG. 4 which shows a flat pattern layout for a zipper 1. The right side has sheathing tabs 4 with nail holes 5. The sheathing bend 3 bends each sheathing tab 4 alternately to the left or right of the rib 2. The left side has rafter tabs 9 with nail holes 10. The edge bend 8 folds each rafter tab 9 down and parallel to the rib 2. The rafter bend 6 bends the rafter webs 7 perpendicular to the rib 2, and alternately with the sheathing tabs 4.

The flat pattern layout shows that the bends 3, 6, and 8 can be made in different directions. For example, instead of alternating, the sheathing tabs 4 can be on one side and the rafter webs 7 on the opposite side. The first and last sheathing tabs 4 can be on one side and the middle rafter webs 7 on the other side. There can be an even number or odd number of sheathing tabs 4 and rafter webs 7.

The length of the zipper 1 can be as small as one sheathing tab 4 and one rafter tab 9, to at least eight feet for installation on a long stud or rafter. The sheathing tabs 4 can be longer, wider, rounded, and square. There can be more nail holes 5 on the sheathing tabs 4 if they are ⅜ inch from the sheathing bend 3, but the alternating sheathing tabs 4 spaces out the nail holes 5 preventing the sheathing S and rafter R from splitting.

The width of the rib 2 can be changed to fit different thicknesses of sheathing, insulation, roofing material, and combinations of materials. The width of the rafter web 7 can be changed to fit different widths of rafters, roof trusses, joists, studs, metal structural members, and metric sizes. For beam sizes of 4×4, 4×6, etc timbers, the nail holes 5 and 10 can be moved accordingly.

The rafter tabs 9 can be of different length and width to fit different varieties of structural members including glue-lams, timbers, and trusses. The edge bend 8 can be adapted to fit about round timbers, hexagon-shaped beams, or I-beams.

FIG. 4A

Figure 4A:
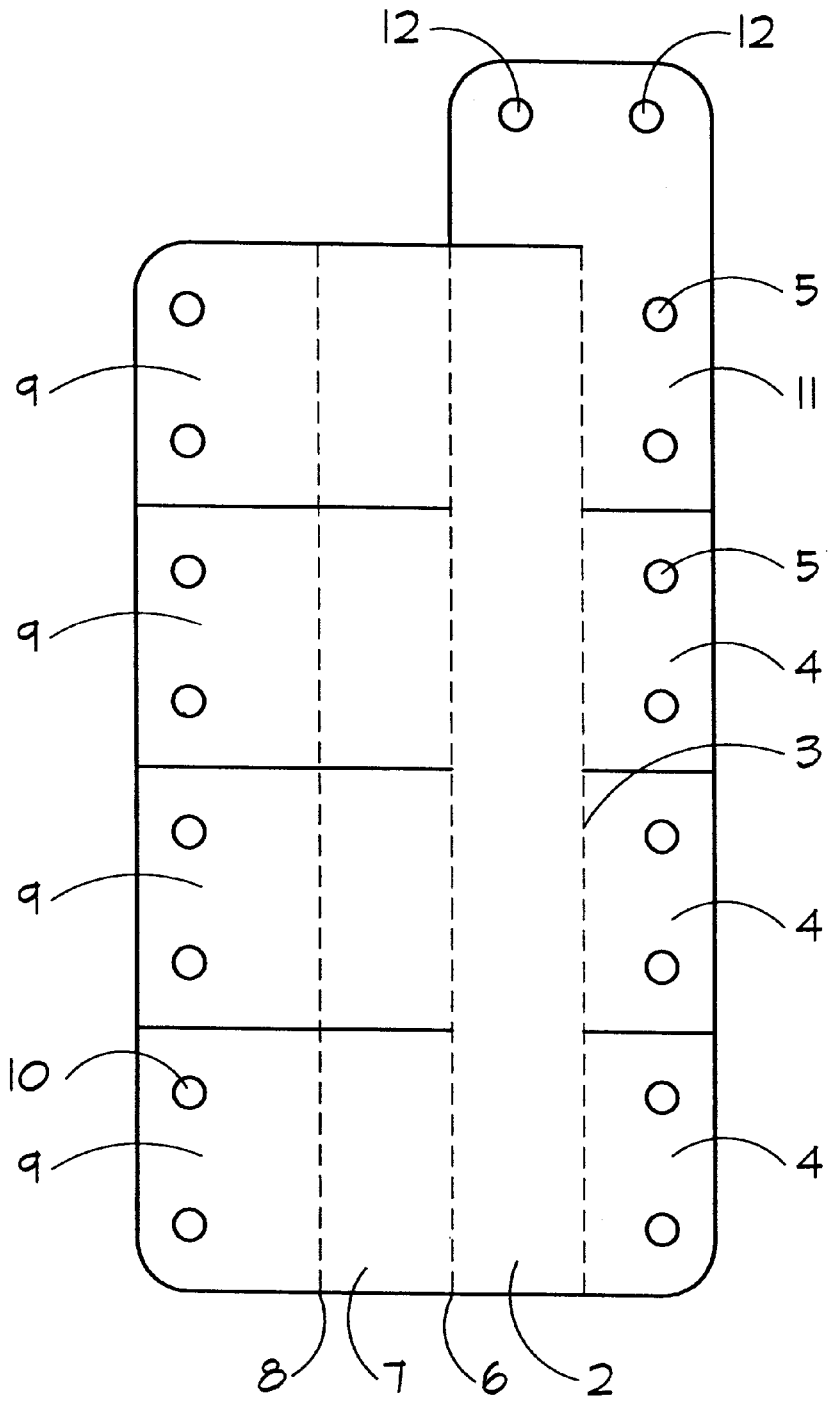
FIG. 4A is a flat pattern layout for a modified zipper.

Refer now to FIG. 4A which shows a flat pattern layout of a zipper 1 that has been modified to hold down three sheets of sheathing S with an extension 11. The extension 11 can be on either end. The zipper 1 can be four-feet long, or longer, with extensions 11 on either end to hold down four sheets of sheathing S.

FIG. 5

Figure 5:
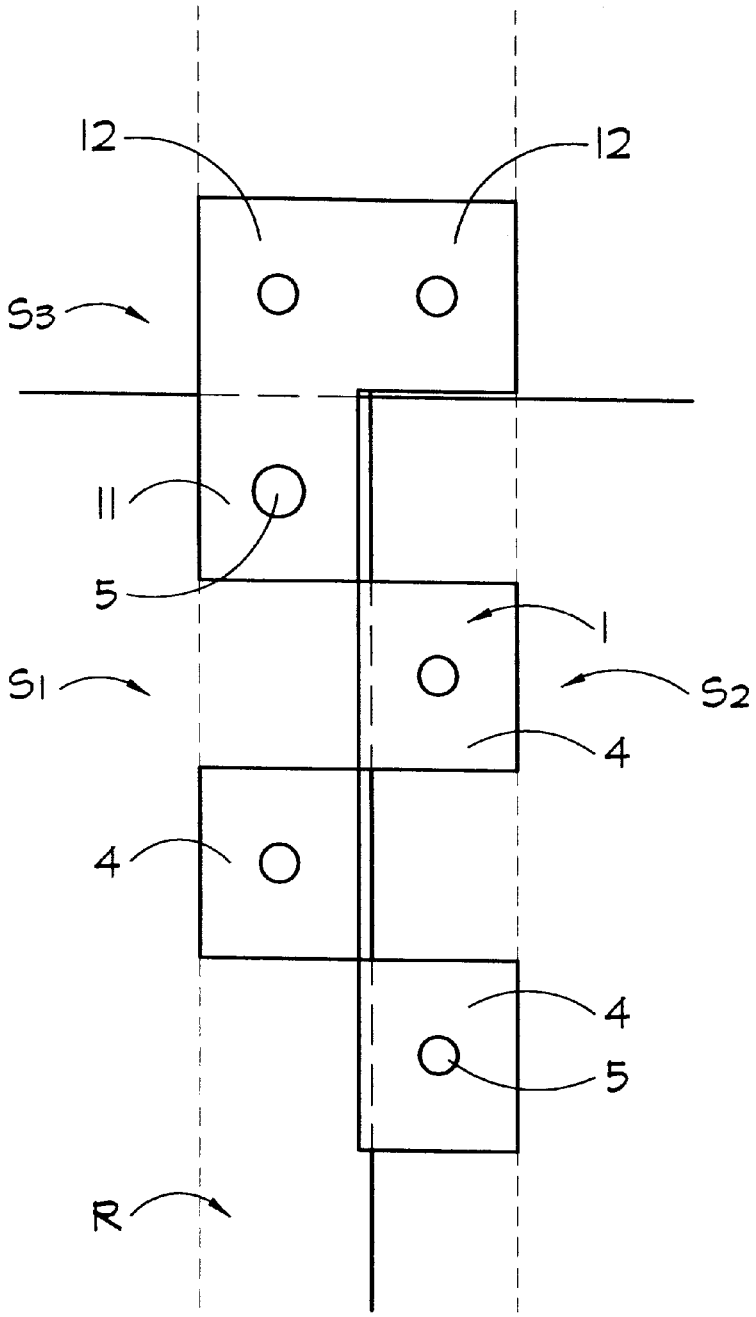
FIG. 5. is a an aerial view of a zipper and sheathing.

Refer now to FIG. 5 which shows how a zipper 1 can be modified to hold down three sheets of sheathing. Sheathing S is usually applied in a staggered pattern (shown on FIG. 15) so the vertical edges are not in line.

FIG. 5 shows an aerial view of a zipper 1 holding down two sheets of sheathing S, on the left and right edge, under the sheathing tabs 4. Both sheets are held down with nails or screws through nail holes 5 driven into the underlying rafter R. A third sheet of sheathing S was slid in from the top and is held down to the rafter R with nails into nail holes 12 through an extension 11 at the sheathing tab 4.

FIG. 5A

Figure 5A:
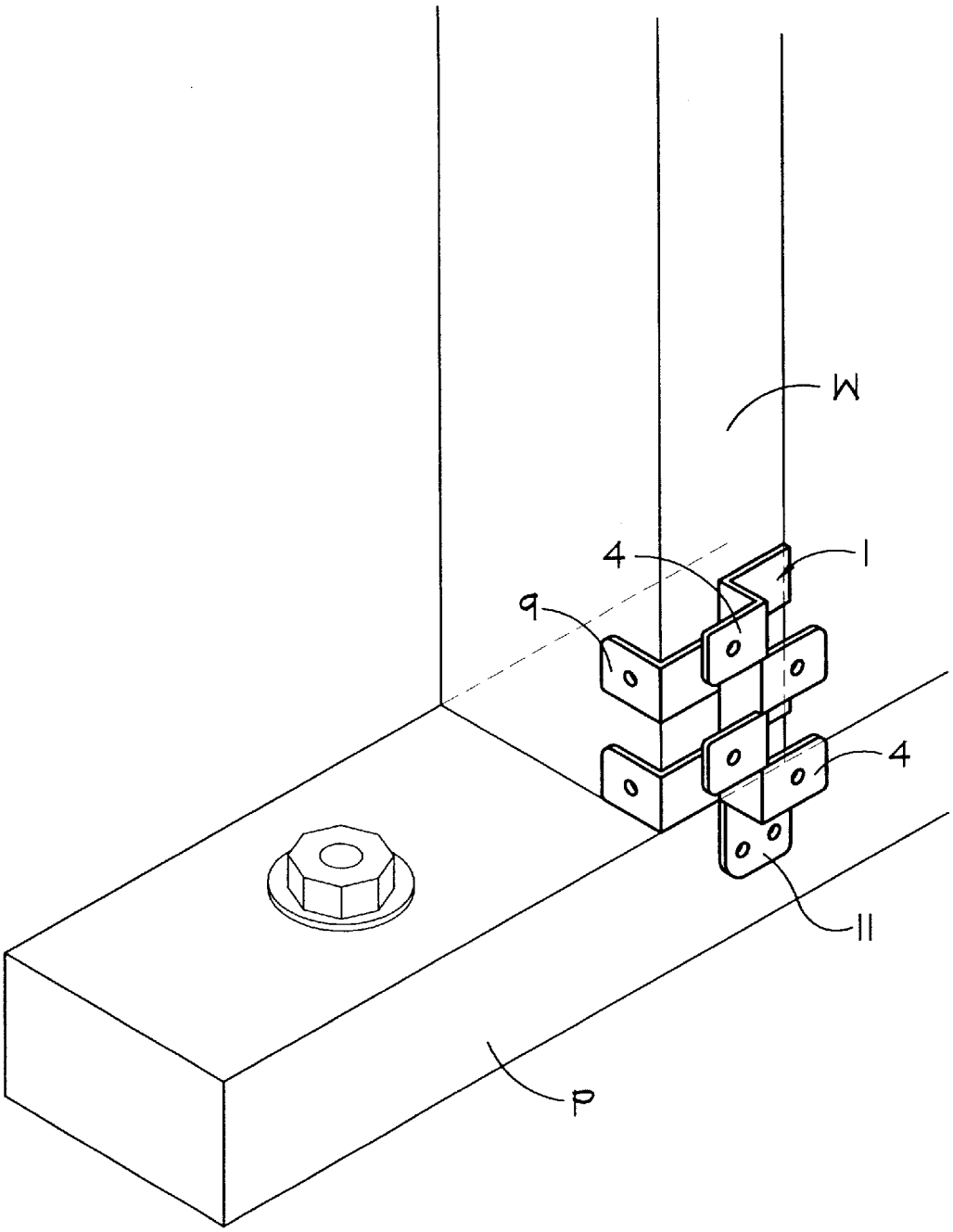
FIG. 5A is a perspective view of a zipper on a wall stud and sill plate.

Refer now to FIG. 5A which shows how a zipper 1 with an extension 11 and bracket 42 can tie together wall sheathing S, wall stud W, and sill plate P.

The extension 11 is attached to the sill plate P and the rafter tabs 9 are attached to the sides of the wall stud W. Wall sheathing S is slid under the sheathing tabs 4 and attached by nails through nail holes 5 into the wall stud W.

Similarly, a zipper 1 with an extension 11 can be attached to the wall stud W, top plate T, and wall sheathing S by turning FIG. 5A upside-down so the sill plate P is a top plate T. A long extension 11 could also tie into both plates of a top plate T.

Zippers 1 tie the wall stud W to the top plate T, the sill plate P to the wall stud W, and adjoining sheets of wall sheathing S securely together. The wall is now a strong shear-wall that can resist and absorb tension, compression, twisting, thrusting, and lateral forces, and transfer these forces to the foundation. Combinations of these forces occur during strong winds and seismic events.

Veneers of brick, stone, metal, and other materials can now be attached to walls, without fear of being shaken or blown off. Veneers of fireproof materials can also be safely applied to a roof that has the sheathing attached to the rafters with zippers 1. Solar electric panels can also be installed without fear of being ripped off by strong winds.

FIG. 6

Figure 6:
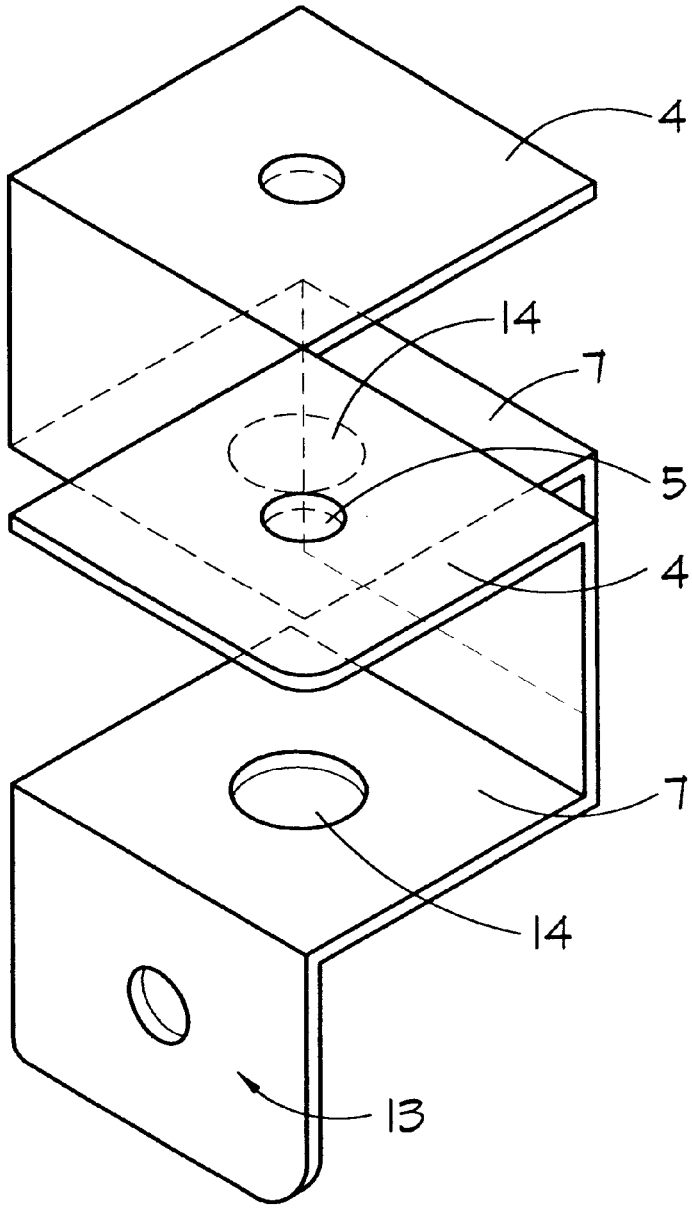
FIG. 6. is a reversible zipper.

Refer now to FIG. 6 which shows a reversible 13 modified from a zipper 1. The reversible 13 has the sheathing tab 4 bent over the rafter web 7. The rafter web 7 has a egress hole 14 that allows a nail from the nail hole 5 on the sheathing tab 4 to penetrate the sheathing S and rafter R. this allows the sheathing to be clamped tightly between the sheathing tab 4 and rafter web 7. Diagonally, a similar sheathing tab 4 and rafter web 7 with egress hole 14 holds down sheathing S on the right.

FIG. 6A

Figure 6A:
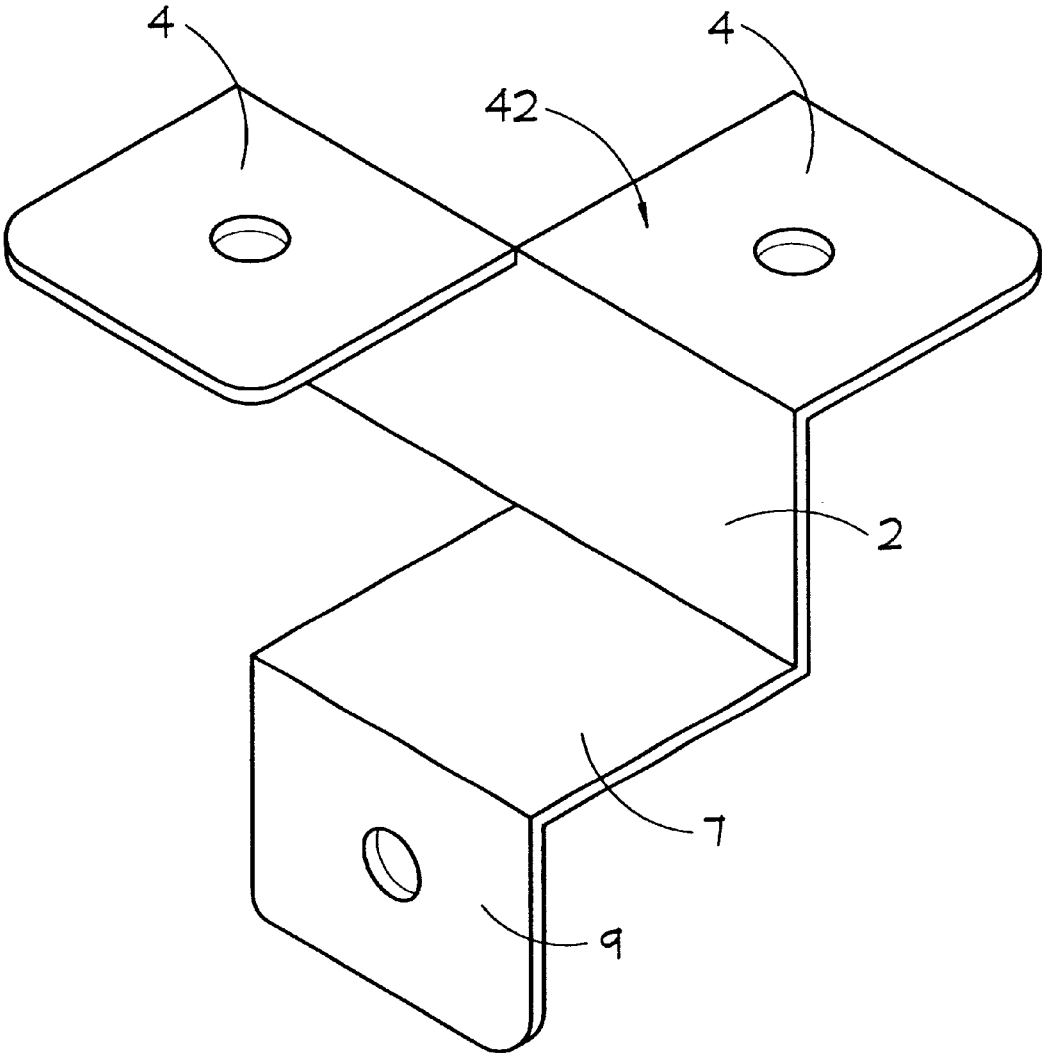
FIG. 6A is half a zipper.

Refer now to FIG. 6A which shows a ½ zipper sheathing tie 42 modified from a zipper 1. The ½ zipper 42 has a left and right sheathing tab 4, and a left and right rafter web 7. The ½ zipper 42 can be use on the first row of sheathing or where the sheathing row is short. This shows how the zipper 1 can have different length for use along different length sheathing. The ½ zipper 42 can be produced at the factory or cut in the field.

FIG. 7

Figure 7:
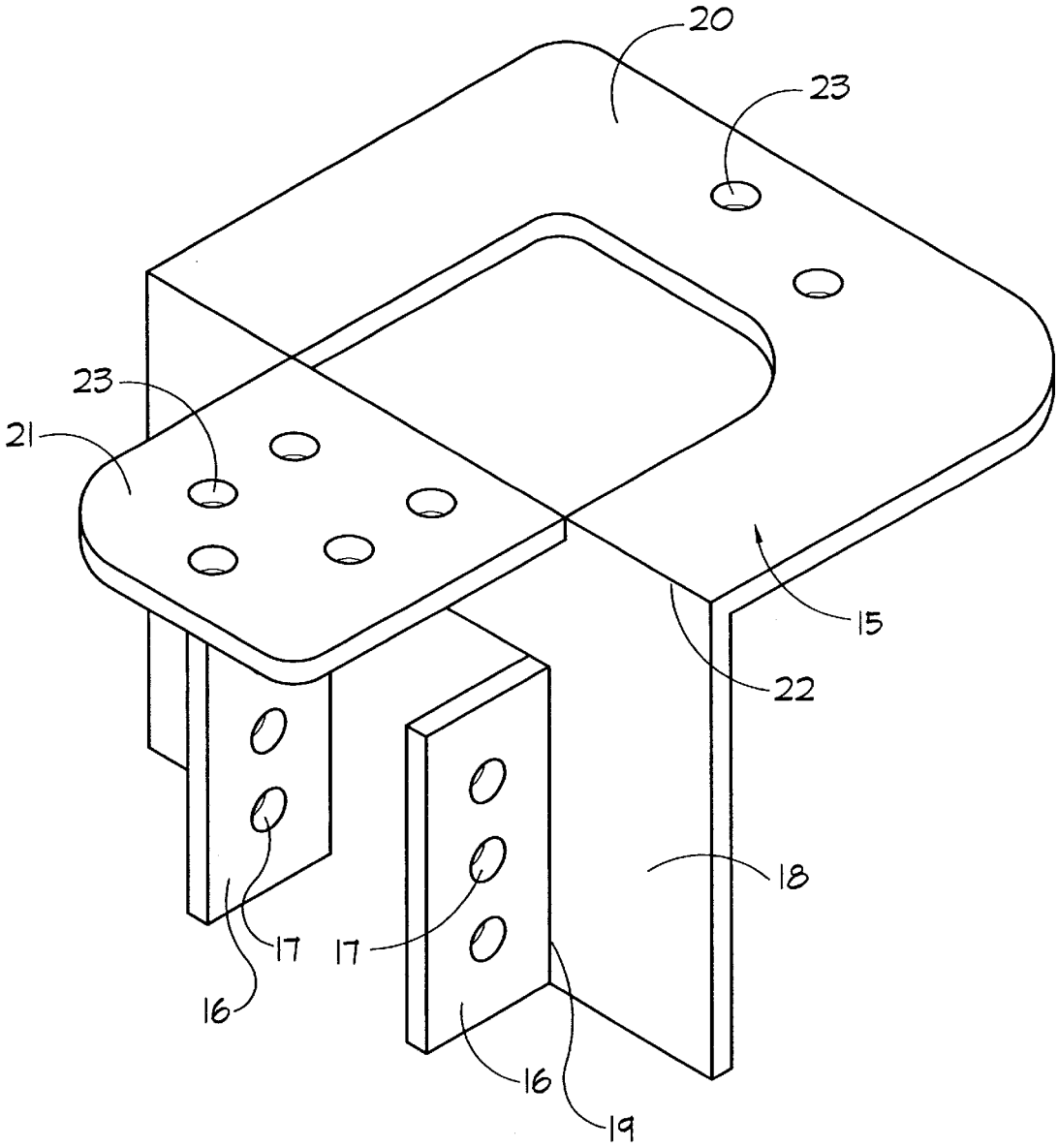
FIG. 7 is a perspective view of a bookend sheathing tie.

Refer now to FIG. 7 which shows a perspective view of a bookend sheathing tie 15. On the bottom of the bookend 15 is a gusset 18. The gusset 18 provides great lateral strength to the bookend 15. Near the middle of the gusset 18, right angle bends form beam bends 19. The beam bends 19 form beam tabs 16 with nail holes 17.

The beam tabs 16 are bent at the beam bends 19 so they are parallel to each other and about 1½ inches apart or about the thickness of a 2× rafter. Nails or screws in the nail holes 17 allow the bookend 15 to be attached to the vertical sides of a rafter R or roof truss. Nails into the wide part of the rafter R prevent uplift of the bookend 15 and attached sheathing S.

The gusset 18, being perpendicular to the rafter R, and above and to either side, prevents the rafter R from twisting under the attached sheathing S. This makes the entire roof of a building into a shear-wall, able to resist and absorb lateral loads from the ground.

The top part of the bookend 15 contains a right-angle top sheathing bend 22. The top sheathing bend 22 forms a front sheathing tab 21 to the front and a back sheathing tab 20 to the rear. Both back and front sheathing tabs 20–21 have nail holes 23 for attachment to sheathing S and the underlying rafter R.

FIG. 8

Figure 8:
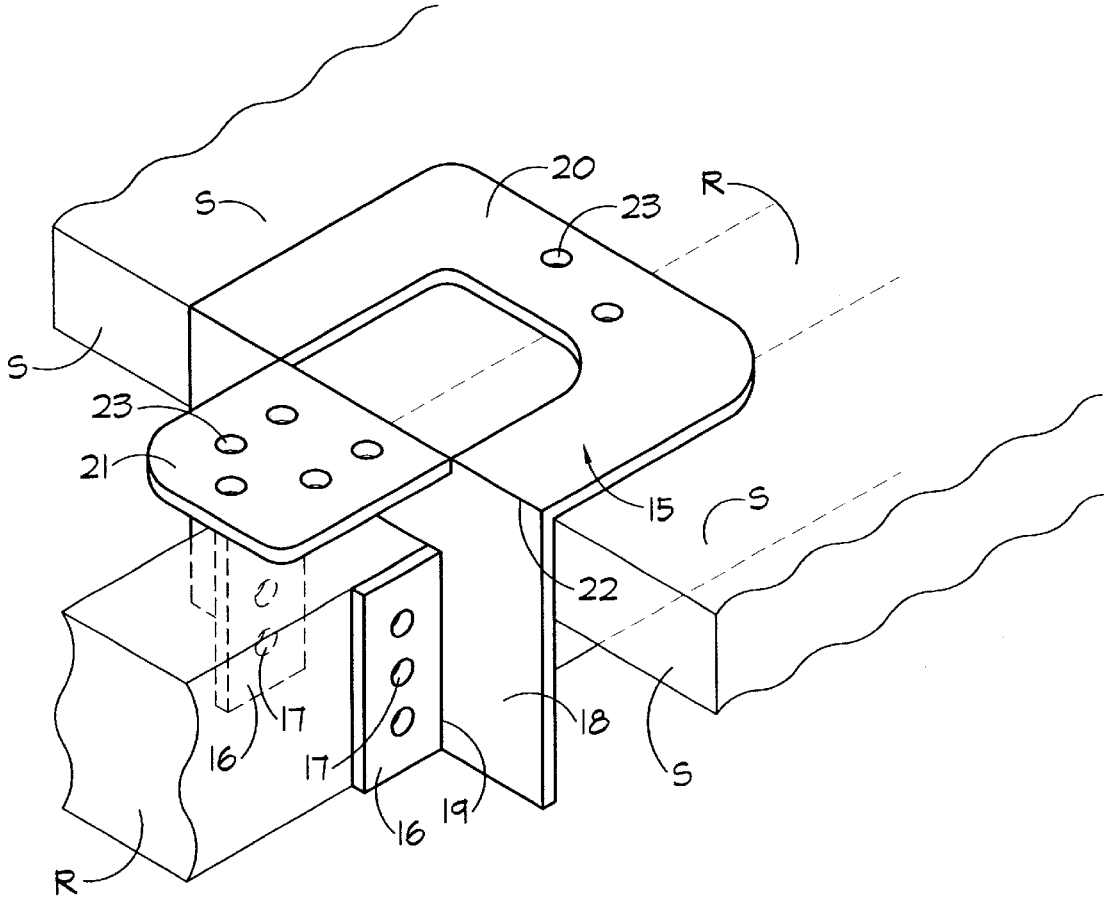
FIG. 8 is a perspective view of a bookend tie holding down roof sheathing.

Refer now to FIG. 8 which shows a bookend 15 installed on a rafter R and sheathing S. The bookend 15 has been attached to a rafter R with nails through nail holes 17 on the beam tabs 16.

The bookend can hold down two or three sheets of sheathing S. The sheathing sheet under the front sheathing tab 21 is a single sheathing sheet S, but is not shown in this view for clarity. The gusset 18 fits between the row of sheathing under the front sheathing tab 21, and the sheathing S under the back sheathing tab 20, and automatically sets an expansion gap between the sheathing sheets S. A zipper 1 to the right of the back sheathing tab 20 can tie down both sheathing sheets S and space them apart.

When a bookend 15 is installed on a floor joist and floor sheathing, this spacing between sheets prevents the floor sheathing from buckling and also prevents two adjacent sheets from rubbing up and down against each other. Tongue and groove plywood would reduce squeaking, but is seldom available, so standard plywood is normally used.

Most floors have an irritating squeak when two adjacent sheets of floor sheathing scrape against each other when stepped upon. This invention securely ties each adjacent sheet of plywood to each other, with a slight gap, and to the underlying joist.

After a house is built, the joist and plywood shrink at different rates, sometimes causing a gap between the joist and sheathing. Movement across this gap will cause it to squeak. Simple nailing will not prevent a gap. The back sheathing tab 20 and front sheathing tab 21 will securely hold the sheathing to the joist, preventing gaps and subsequent squeaks even if the woods shrink at different rates, Prior to this invention, framers were not sure of how far the correct spacing should be between sheets of plywood, or even if there should be a spacing. The spacing will now be automatic when a bookend 15 is used.

Underneath the back sheathing tab 20, two sheets of sheathing S meet on the rafter R. The sheets are spaced apart by a zipper 1, further up the rafter R. The broad surface area of the back sheathing tab 20 clamps down both sheets of sheathing S. Nails in the nail holes 23 accurately hit the correct edge of the sheathing S and underlying rafter R.

The right angle bend at the top sheathing bend 22 forms the perpendicular gusset 18, and the right angle bend at the beam bends 19 forms the perpendicular beam tabs 16. These perpendicular angles and webs can absorb and deflect forces from several directions. Up and down forces would be absorbed and transmitted, as would side to side movements.

The tie would absorb and transfer forces much better than just nails or screws. Previous to this invention, when nails were driven into the sheathing and structural member, the nails worked independently to resist forces. With this connector, all the nails driven in the connector, sheathing, and structural member work together to resist forces.

The bookend 15 can be installed on a rafter R above the first row of sheathing S, near the midpoint, so the front sheathing tab 21 is cinching down the sheathing S. The bookend 15 can be nailed to the rafter R using nails through the nail holes 17 in the beam tabs 16. When the next row of sheathing S is laid down in a staggered pattern, two sheets will meet under the back sheathing tab 20. These two sheets will be correctly spaced from the sheet under the front sheathing tab 21 by the gusset 18.

FIG. 9

Figure 9:
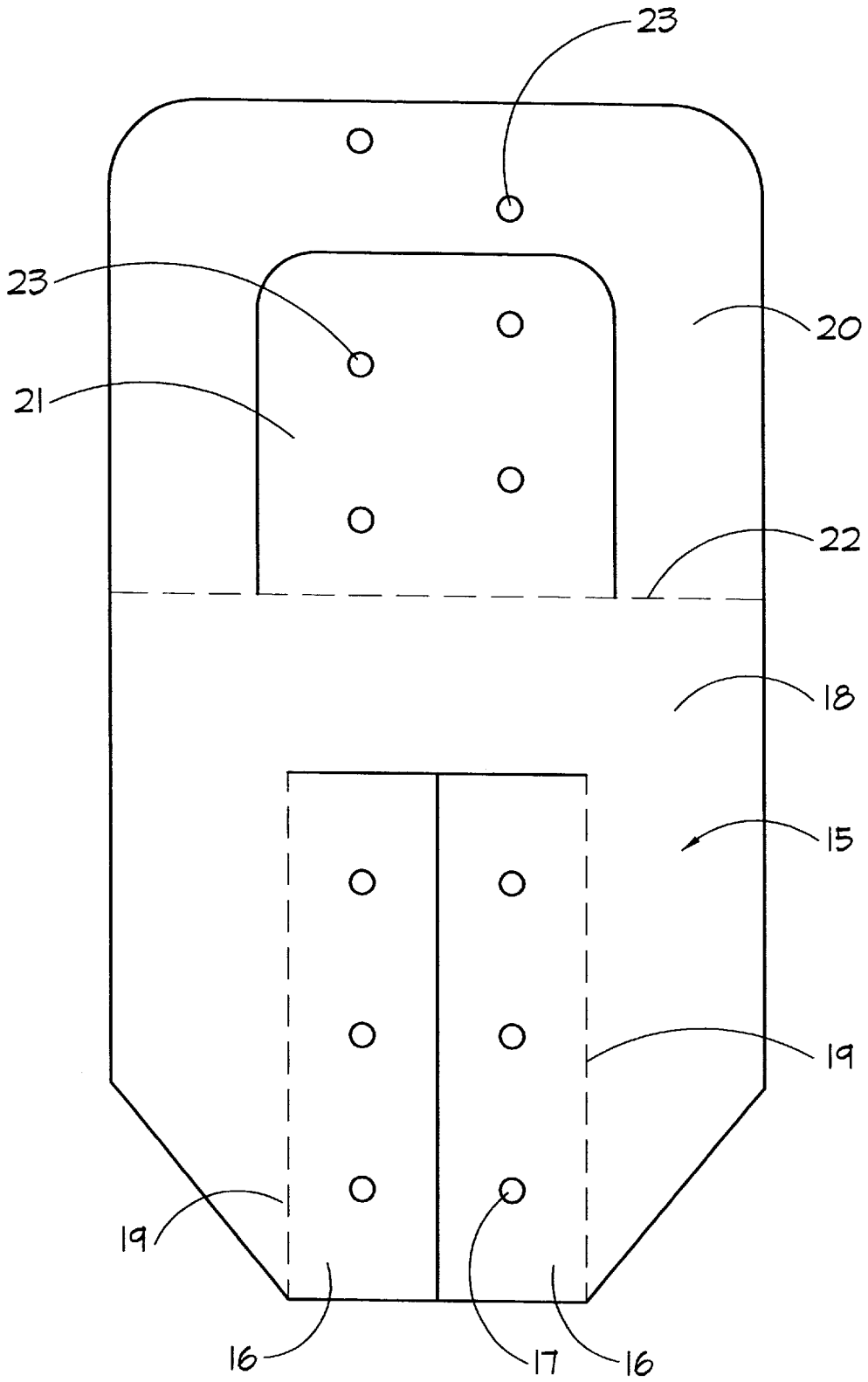
FIG. 9 is a flat pattern layout for a bookend.

Refer now to FIG. 9 which shows a flat pattern layout for a bookend 15 with each piece specified. The preferred cut lines are solid and the bend lines are dashed. The bends can be in several directions, putting the beam tabs 16 to the front, to the back, or staggered, but they are easier to nail under the front sheathing tab 21. The flat pattern layout shows that there is little wasted material, and is made from one sheet with no welding. Some variation in forms can be fashioned.

FIG. 10

Figure 10:
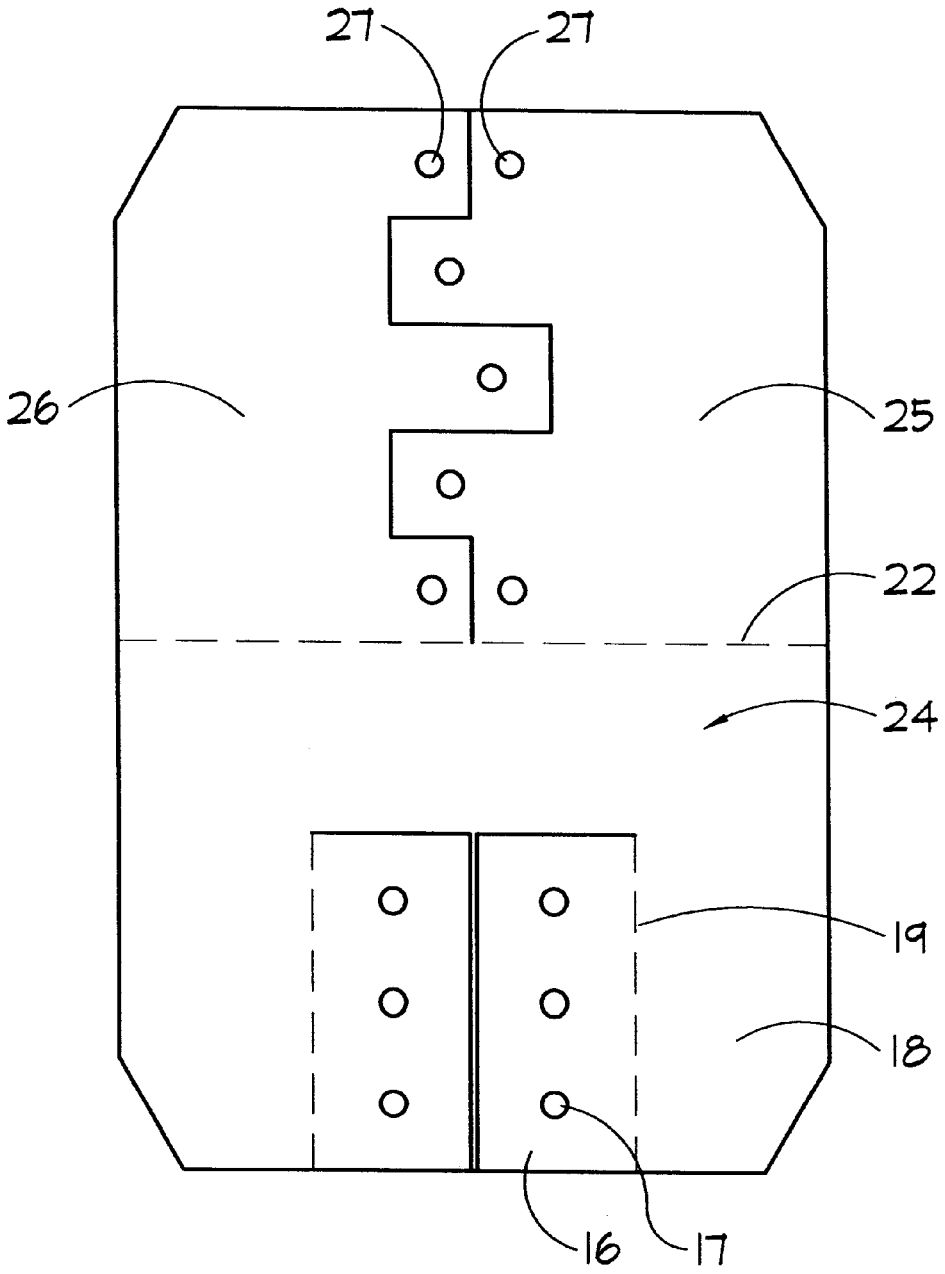
FIG. 10 is a flat pattern layout of an E-clip.

Refer now to FIG. 10 which shows a flat pattern layout for an E-clip 24. The bottom part of the E-clip 24, below the top sheathing bend 22, is similar to a bookend 15. Above the top sheathing bend 22, the right sheathing web 24 is bent to the front and the left sheathing web 26 is bent to the back.

The right sheathing web 24 can be bent to the back, and the left sheathing web 25 can be bent to the front, but both are bent opposite each other. Both webs 24–25 have nail holes 27 for attachment to sheathing S and the underlying rafter R.

The E-clip 24 has a broad surface area in the left sheathing web 25 and right sheathing web 24, for holding down the sheathing S. The E-clip has nail holes 27 spaced for the field of the sheathing S and maximum holding into the rafter R.

FIG. 11

Figure 11:
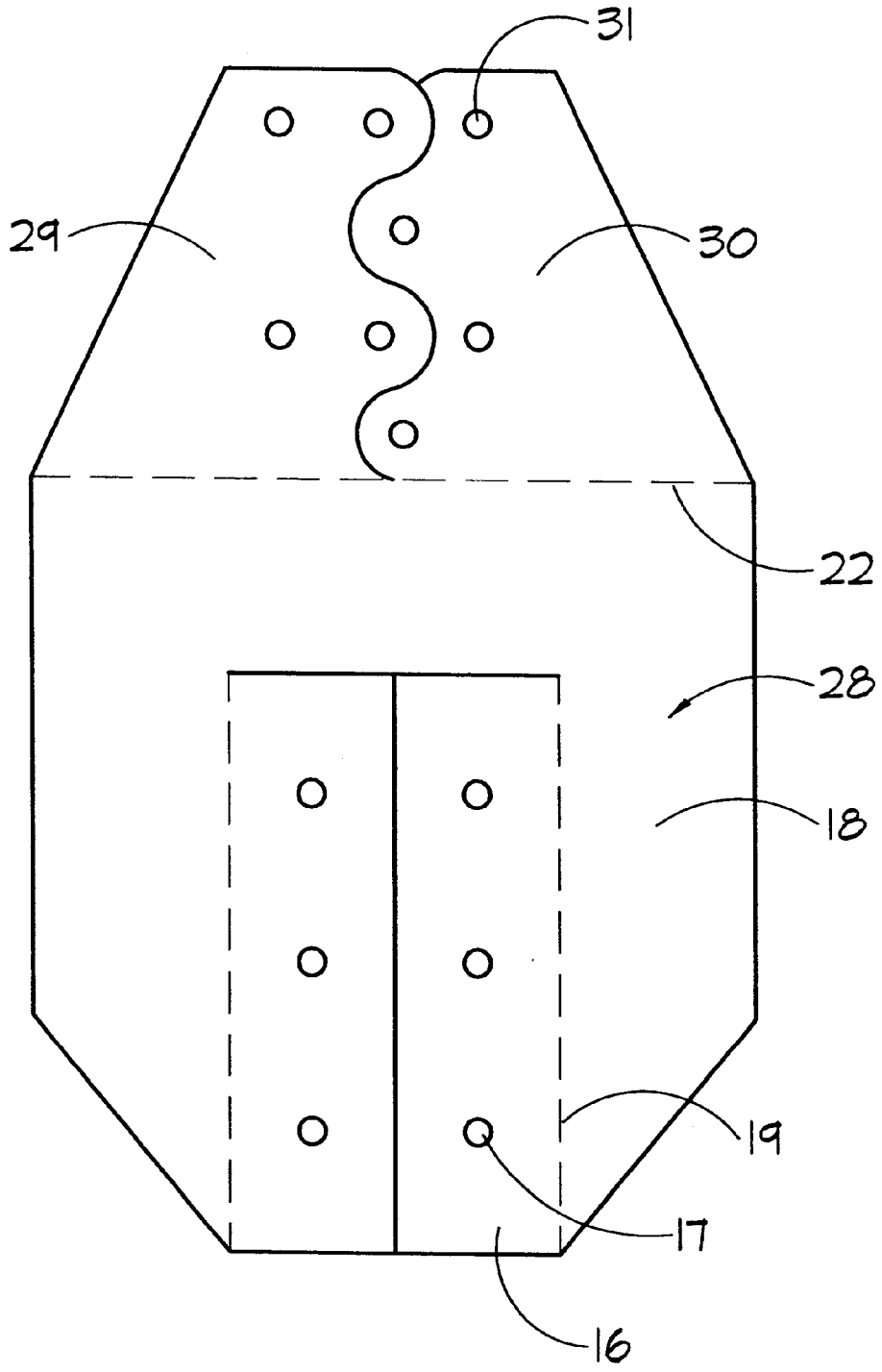
FIG. 11 is a flat pattern layout of an S-clip.
Figure 12:
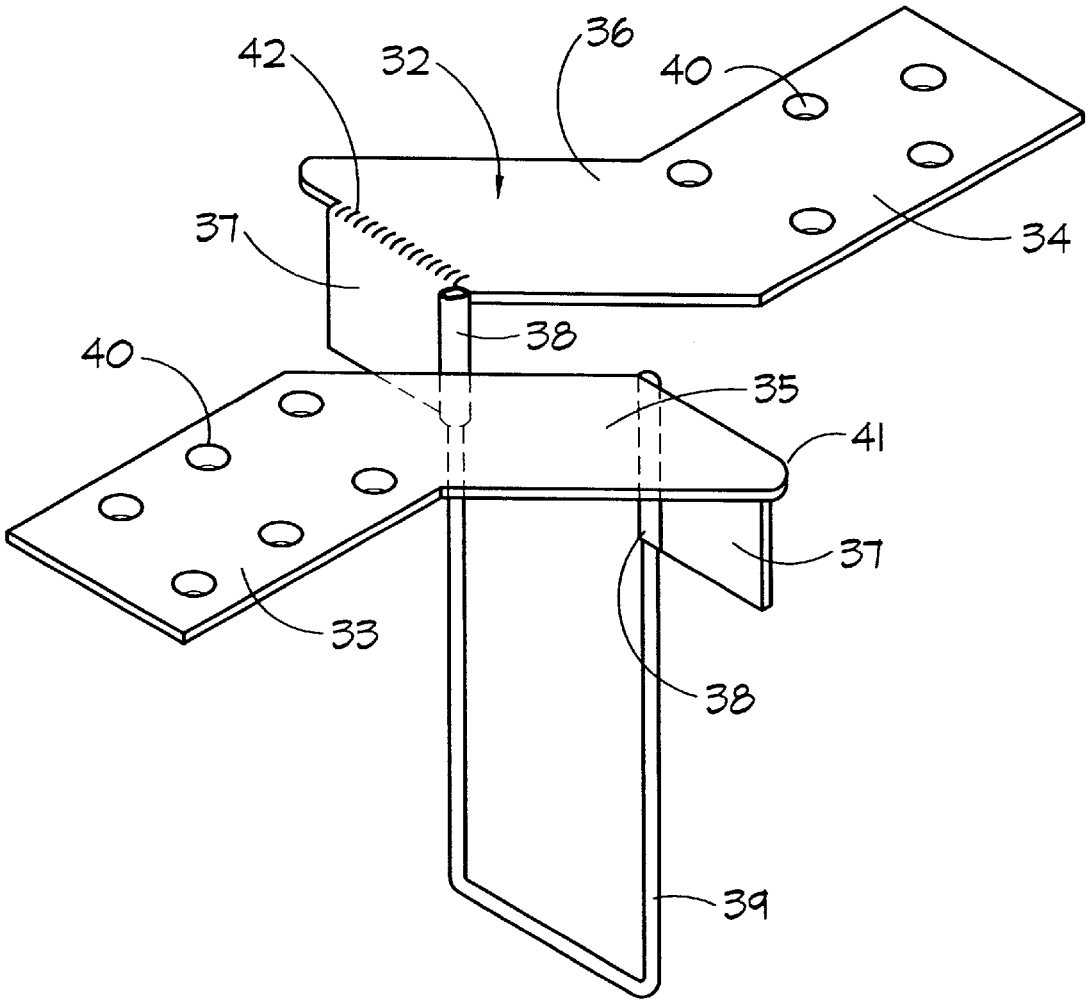
FIG. 12 is a perspective view of an adaptable sheathing tie.

Refer now to FIG. 11 which is a flat pattern layout for a S-clip 28. The S-clip 28 is similar to an E-clip 24, but shows how there can be changes in style. The top part of the S-clip 28 has a left sheathing trap 29 and right sheathing trap 30 bent opposite each other at the top sheathing bend 22. The S-clip also holds down adjacent sheets of sheathing S to the underlying rafter R with nails through the nail holes 31.

If both the left and right sheathing traps 29–30 are bent to the back, and both beam tabs 16 are bent to the back, the S-clip 28 can be used on the first course of sheathing S. This will also work on the E-clip 24 and the bookend 15.

FIG. 10 and 11 show how the top part of a sheathing tie can have different forms. There can be other variations.

FIG. 12

Refer now to FIG, 12 which shows a perspective view of an adaptable sheathing tie 32. The adaptable sheathing tie 32 consists of a left sheathing strap 33 and right sheathing strap 34 connected by a strong cable 39.

The left sheathing strap 33 has nail holes 40 at one end, for attachment to sheathing S and underlying rafter R. The other end has a left sheathing offset 35 and a right angle bend 41 that forms a spacer rib 37. The spacer rib 37 has an anchor 38 on the inner side.

The right sheathing strap 34 has nail holes 40 at one end, for attachment to sheathing S and underlying rafter R. The other end has a right sheathing offset 36 and a right angle bend 42 that forms a spacer rib 37. The spacer rib 37 has an anchor 38 on the inner side.

A strong cable 39 runs from an anchor hole 38 on the left sheathing strap 33 to an anchor hole 38 on the right sheathing strap 34. The cable 39 can be wrapped around a structural member during construction with the left sheathing strap 33 on one side, and the right sheathing strap 34 on the other side. The cable can be made from metal, chain, plastic, nylon, kevlar or other strong, flexible material.

FIG. 13

Figure 13:
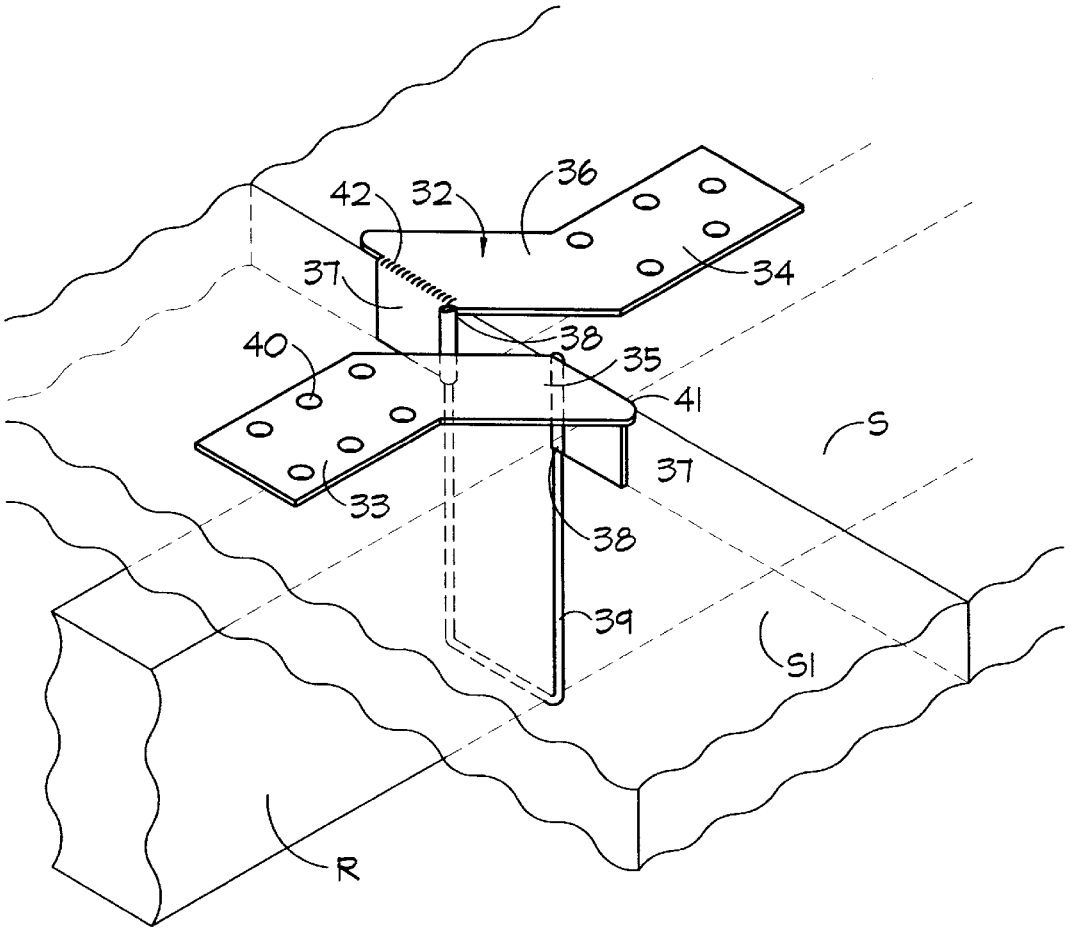
FIG. 13 is a perspective view of an adaptable sheathing tie. holding down roof sheathing.

Refer now to FIG. 13 which shows an adaptable sheathing tie 32 mounted on sheathing S and an underlying rafter R. The lower sheathing sheet S1 was installed on the rafter R, and an adaptable sheathing tie 32 was installed with the cable 39 wrapped under the rafter R.

The left sheathing strap 33 was installed over the sheathing S1 and underlying rafter R. The left sheathing offset 35 puts the anchor 38 against the vertical edge of the rafter R. The spacer rib 37 spaces the sheathing apart for expansion, and provides lateral support against the rafter R.

The right sheathing strap 34 was installed over the sheathing S2 and underlying rafter R. The right sheathing offset 36 puts the anchor 38 against the vertical edge of the rafter R. The spacer rib 37 spaces the sheathing apart for expansion, and provides lateral support against the rafter R.

Nails driven through the nail holes 40 in the left and right sheathing straps 33–34 brings the sheathing straps down against the sheathing and raises the cable 39. The cable 39 will tighten against the underside and side of the rafter R providing a secure bond between the rafter R and both sheets of sheathing S1–S2.

The adaptable sheathing tie 32 can tie two or three sheets of sheathing S together. A standard nylon tie can be used as the anchor 38, by being pulled tight around the rafter R and the excess cut off at the opposite side.

FIG. 14

Figure 14:
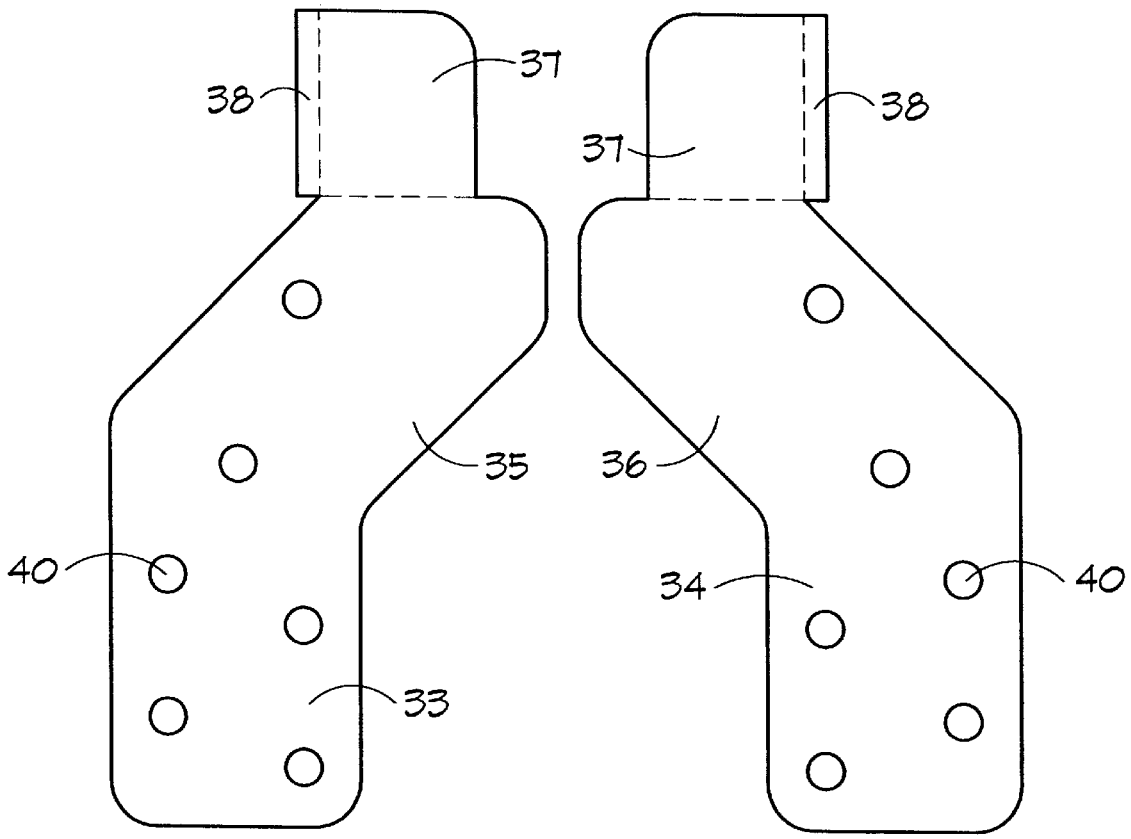
FIG. 14 is a flat pattern layout of an adaptable tie.

Refer now to FIG. 14 which shows a flat pattern layout of an adaptable sheathing tie 32. The left sheathing strap 33 with nail holes 40, left sheathing offset 35, spacer bend 41, spacer rib 37 and anchor 38. The bend and rolling of the anchor have not occurred. The cable 39 can be swaged to the anchors 38, or by other tool and die methods.

The right side shows a right sheathing strap 34 with nail holes 40, right sheathing offset 36, spacer bend 41, spacer rib 37 and anchor 38. The cable can be made of different materials and different lengths in order to fit on different shape and different width beams.

FIG. 15

Figure 15:
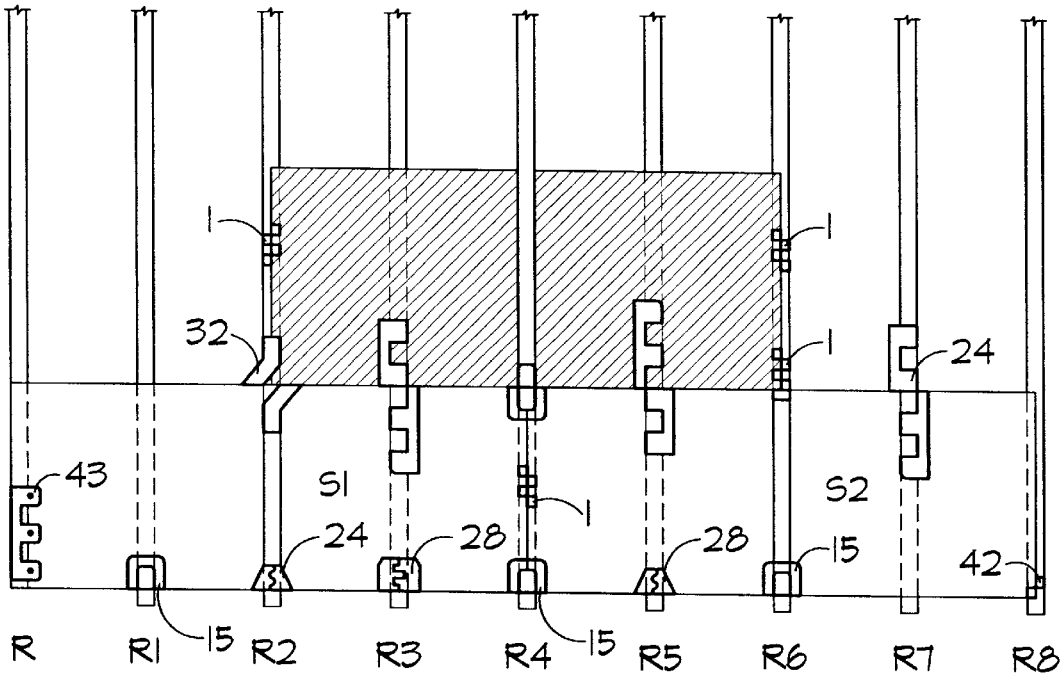
FIG. 15. is a an aerial view showing locations of sheathing ties on sheathing.

Refer now to FIG. 15 which shows an aerial view of sheathing S laid on top of a roof. This view could be of floor sheathing or wall sheathing. This view shows the location of sheathing ties on sheathing S and rafters R.

There are nine rafters on FIG. 15, marked R–R8, that are 24 inches-on-center. Three sheathing sheets S1–S3 that are the standard 4×8 feet have been laid down on the rafters R. Sheathing sheets S1 and S2 are part of the first row.

On rafter R, the gable end of the roof, an edge zipper 43 ties the edge of the sheathing S to the rafter R. If the sheathing S extends to the gable side, beyond the rafter R, the edge zipper 43 can be attached to the sheathing and rafter R from underneath the roof.

On rafter R1, a bookend 15, with the back and front sheathing tabs 20–21 are bent together over the sheathing S1, and the beam tabs 16 are bent against the rafter R under the sheathing S1. This ties down the critical leading edge of the sheathing S with none of the connector sticking out.

Similarly, a bookend 15 is holding down the leading edge of the sheathing at rafters R4 an R6. A similarly bent E-clip 24 is holding down the leading edge at rafter R2. Similarly bent S-clips 28 are holding down the leading edge at rafter R3 and R5.

On rafter R8, a ½ zipper 42 is holding down sheathing at the horizontal edge of the building and on the vertical edge of a sheet of sheathing. Other ties are labeled on FIG. 15.

FIG. 15 can also show how the sheathing would behave during hurricane and earthquake forces, and how all the ties counteract and absorb these forces. The ties prevent uplift of sheathing, when installed on a roof; and prevent blow out of sheathing, when installed on a wall. But during a hurricane, wind acts on a building in other ways.

When FIG. 15 represents a roof, and the wind was blowing from the left, the force would try and lift and rack the roof. Hurricanes can last for eight hours or more. Under the constant wind gusts, nails holding down the sheathing can fatigue or the plywood can split and the sheathing will separate from the rafter. The ties, with their large surface area, will prevent fatigue from occurring. Winds coming from the front, would try and lift the roof, but the ties with their large surface and holding power will prevent uplift.

If FIG. 15 represents a wall, an earthquake tremor from below would transmit a force upward and side to side. This force would try and slide the sheathing over each other. The ties would prevent that from happening, forming the wall into a shearwall.

If the earthquake sent a shaking force through the wall, the wall would try and rack or move side to side. Since the studs are securely fastened to each other using the wall sheathing and ties, the wall will remain standing. Earth tremors would also try and slide the sheathing over each other, but the ties would prevent it.

FIG. 16

Figure 16:
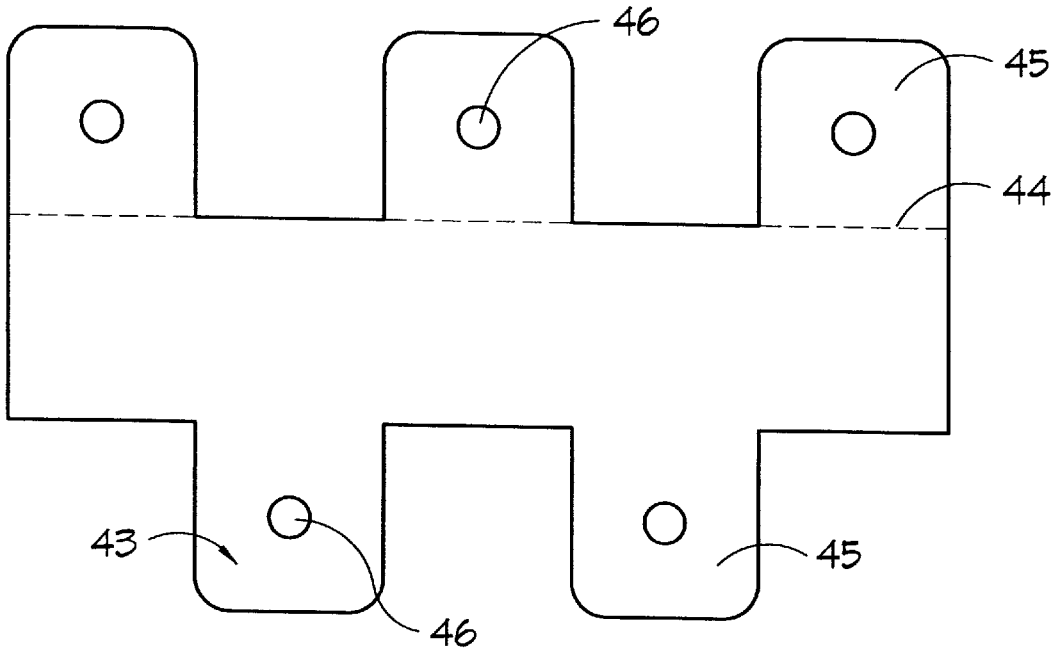
FIG. 16. Is a flat pattern layout of an edge zipper.

Refer now to FIG. 16 which shows a flat pattern layout for an edge zipper 43. The offset bend 44 divides each part of the edge zipper 43 into long and short alternating edge tabs 45 with nail holes 46. The edge zipper 43, like the zipper 1, nests during manufacture so there is little waste.

FIG. 17

Figure 17:
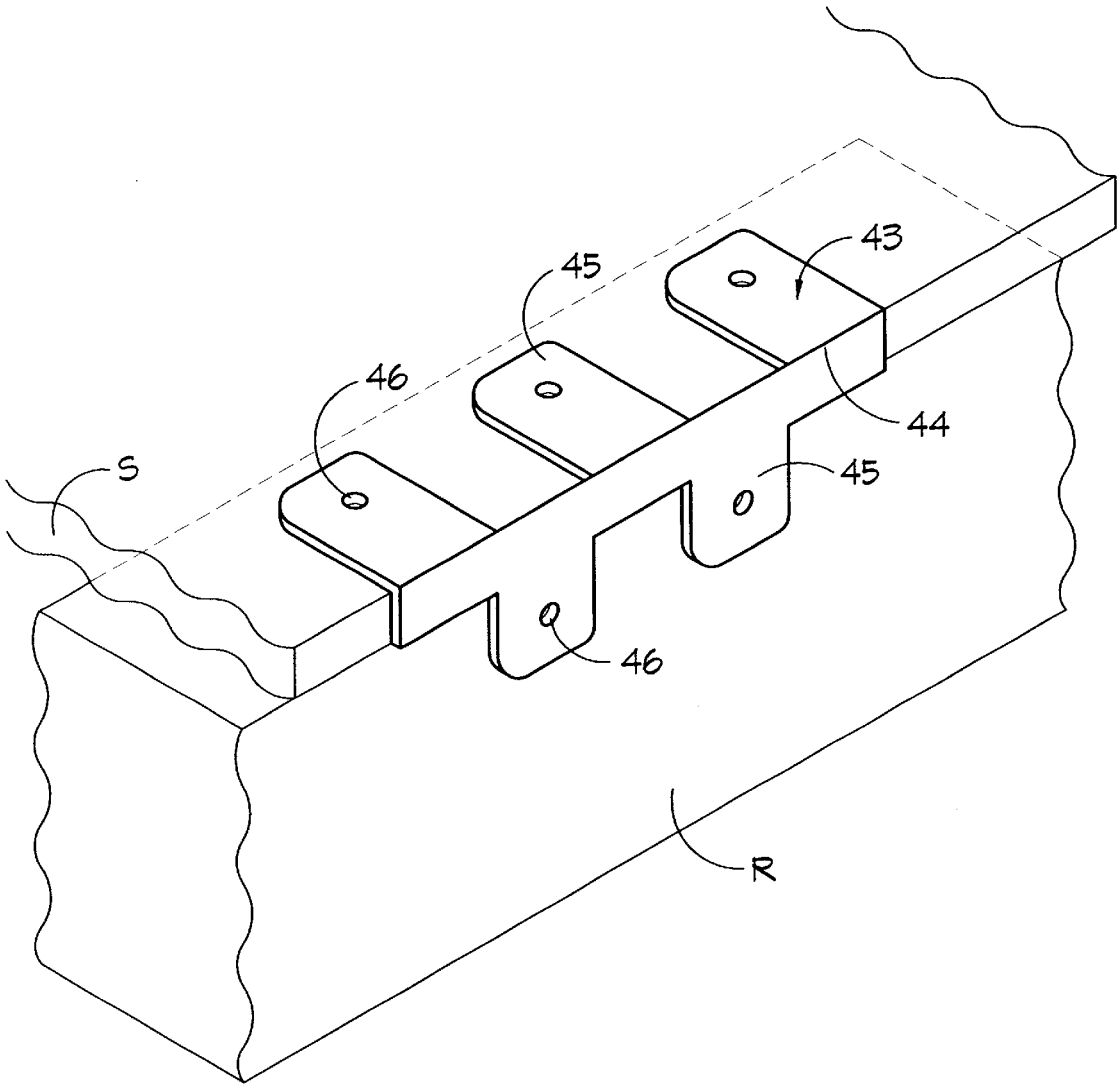
FIG. 17. Is a perspective view of an edge zipper holding down sheathing to a rafter.

Refer now to FIG. 17 which shows a perspective view of an edge zipper 43 holding down the edge of sheathing S to a rafter R. The nail holes 46 on the short edge tabs 45 are spaced about ¾ inch from the offset bend 44. On the top part, this puts nails in the center of the underlying 1½-inch-thick rafter R. On the side, the long edge tabs 45 puts nail holes 46 approximately 1½ inches down on the rafter R, over the meat of the rafter R.

The edge zipper 43 can be used under the roof if the sheathing S extended beyond the rafter R. The edge zipper 43 would have screws go up into the sheathing S and sideways into the rafter R. The edge zipper 43 can also be used to tie edges of sheathing S to a wall or floor.

The edge ties 43 can be made with the offset bend 44 in the center, dividing the tie in half, for use on square timbers, or on a corner post where two perpendicular sheets of sheathing S would meet.

The length of the edge tabs 45 can be of different or alternating lengths, that is each odd edge tab 45 can be 2-inches-long, and each even edge tab 45 can be 1-inch long. The opposite side would be mirror image. Nail holes 46 can be staggered on the edge tabs 45 and there can be several nail holes 46 for nailing into different thicknesses of sheathing S.

Conclusion, Ramifications, and Scope

Thus, the reader will see that the sheathing tie of the invention provides a simple and economical connector that allows a builder to quickly, easily, and accurately secure weak parts of a building against earth tremors and high winds.

While my above description contains many specificities, these should not be construed as limitations on the scope of the invention, but rather as an exemplification of one preferred embodiment thereof. Many other variations are possible.

There can be minor variations in size, and materials. For example, the ties can have more rounded corners, squarer corners, wavy lines instead of straight lines, more nail holes, slightly less nail holes, or be thicker or thinner, wider or longer. The ties can be made for 2×4's and ¾ inch sheathing, or 2×6's with ⅝ inch sheathing or many other combinations of sheathing or beam size.

The ties can have different dimensions to fit the particular plans of the engineer and architect. In areas that have high winds or earthquakes, the ties could be thicker, wider, or have more nail holes. There could be more or less ties on each sheet, depending on the size of the sheet.

The ties can hold down boards instead of sheathing; they can also hold down insulated sheets or metal sheets. If the sheathing tabs 4, 20–21 were formed with waves, they could hold down corrugated metal and fiberglass roofs. If the grasps were formed with hills and valleys, the ties could hold down pan deck (metal forms used to hold concrete for floors, on high rise buildings).

The ties can have a variety of shapes stamped in the sheathing tabs (4, 20 and 21) to hold down a variety of objects against sheathing.

The ties can have an underpass stamped in the sheathing tabs (4, 20 and 21) to hold down cable, wire, belts, or metal bands on top of the sheathing.

The ties can have tongues and groves stamped into the ribs 1 for use on sheathing that has tongue and groove edges.

The ties can have round rafter tabs 9 in order to fit around circular columns.

In instances where the rafters are warped, twisted, or bowed, the ties can help straighten them by securing the plywood down tightly with screws. On rough or un-planed boards, timbers, or beams, the ties, by wrapping around the edges of the timbers, form a secure connection to the sheathing.

The ties can be attached to different types of structural beams including wood, plastic, metal, concrete, or light-weight composite materials. The ties can hold down different types of sheathing including wood, glass, plastic, metal, concrete, slate, and mane-made materials.

The ties can be stamped as mirror images of the flat pattern layouts, for example, creating a tie with the sheathing tabs 4 and rafter webs 7 on reversed sides.

The ties can be made of metal by stamping, forging, or casting. The ties can be made of plastic, by molding or casting. The ties can be made of recycled materials. The ties can be made with bright colors, so a builder or inspector knows they are in position. They can be of different thicknesses, where the gap between each sheet has to be a specific distance.

Accordingly, the scope of the invention should be determined not by the embodiments illustrated, but by the appended claims and their legal equivalents.

I claim:

1. Apparatus for securing sheathing to structural members of a building comprising:

a. a unitary body having a rib, sheathing tabs, rafter webs, and rafter tabs;

b. said rib being rectangularly shaped and having front and back planar surfaces, a plurality of sheathing tab flanges projecting at right angles from a long edge thereof, and a plurality of rafter web flanges projecting at right angles from an other long edge thereof; and, c. each said rafter web having an edge connected with said rib and an opposing edge, said opposing edge having a flange projecting away from said sheathing tabs, forming said rafter tab, as a means of placing said rafter tabs against opposite broad faces of said structural member.

2. The apparatus of claim 1 wherein said rib comprises a spacing means for spacing adjacent edges of sheets of said sheathing over said structural member.

3. The apparatus of claim 1 wherein said sheathing tabs project alternately to the left and right of said rib, along the length of said rib, such that said sheathing tabs are located on opposite sides of said rib.

4. The apparatus of claim 1 wherein said rafter webs project alternately to the left and right of said rib, along the length of said rib, such that said rafter webs are located on opposite sides of said rib.

5. The apparatus of claim 1 wherein said rafter webs and said sheathing tabs have an approximately equal width and are alternately bent left and right of said rib, along the length of said rib, such that said sheathing tabs are located between said rafter webs on either side of said rib.

6. The apparatus of claim 1 wherein said rib has a predetermined height so said sheathing is clamped between said sheathing tabs and said rafter webs.

7. The apparatus of claim 1 wherein said sheathing tabs have a predetermined area and one or more nail holes for securely and accurately attaching sheathing to said structural member.

8. The apparatus of claim 1 wherein said rafter tabs have a predetermined area and one or more nail holes for attachment to broad opposite faces of said structural member.

* * * * *